US009243518B2

(12) United States Patent
Cook

(10) Patent No.: US 9,243,518 B2
(45) Date of Patent: Jan. 26, 2016

(54) WASTE HEAT RECOVERY SYSTEM

(75) Inventor: David Cook, Novi, MI (US)

(73) Assignee: Sandra I. Sanchez, Fullerton, CA (US)

( * ) Notice: Subject to any disclaimer, the term of this patent is extended or adjusted under 35 U.S.C. 154(b) by 527 days.

(21) Appl. No.: 12/884,157

(22) Filed: Sep. 16, 2010

(65) Prior Publication Data

US 2011/0072818 A1 Mar. 31, 2011

Related U.S. Application Data

(60) Provisional application No. 61/244,106, filed on Sep. 21, 2009.

(51) Int. Cl.

| | |
|---|---|
| ***F01K 13/00*** | (2006.01) |
| ***F01K 23/06*** | (2006.01) |
| ***F01K 13/02*** | (2006.01) |
| ***F01K 25/10*** | (2006.01) |

(52) U.S. Cl.

CPC ..... *F01K 23/065* (2013.01); *F01K 13/02* (2013.01); *F01K 25/10* (2013.01)

(58) Field of Classification Search

CPC ..... F01K 25/08
USPC ..... 60/645, 670, 651
See application file for complete search history.

(56) References Cited

U.S. PATENT DOCUMENTS 3,194,216 A * 7/1965 Grabowski ..... F28G 9/00 122/379
3,350,876 A 11/1967 Johnson
3,945,210 A 3/1976 Chapin
3,948,053 A 4/1976 Gamell
4,330,998 A * 5/1982 Nozawa ..... F01K 25/10 60/651
4,334,409 A 6/1982 Daugas
4,342,921 A 8/1982 Williams
4,362,020 A 12/1982 Meacher et al.
4,394,582 A 7/1983 Kreissl et al.
4,586,338 A 5/1986 Barrett et al.
4,847,525 A * 7/1989 Sukoriansky ..... H02K 44/085 310/11

(Continued)

FOREIGN PATENT DOCUMENTS

WO WO 2008125827 A2 * 10/2008

OTHER PUBLICATIONS

Henry A. Mlcak, PE; An Introduction to the Kalina Cycle; PWR—vol. 30, Proceedings of the International Joint Power Generation Conference; Book No. H01077-1996; ASME Intl, NY.

*Primary Examiner* — Kenneth Bomberg
*Assistant Examiner* — Shafiq Mian
(74) *Attorney, Agent, or Firm* — Richards Patent Law P.C.

(57) ABSTRACT

To mitigate the potential significant impact on our society due to the continued reliance on high-cost diesel hydrocarbon fuel and the implementation of increasingly strict emission controls, an apparatus is disclosed which provides the means for extracting additional heat from an internal combustion engine while providing the cooling needed to meet stricter emissions standards. The present disclosure describes an apparatus operating on a Rankine cycle for recovering waste heat energy from an internal combustion engine, the apparatus including a closed loop for a working fluid with a single shared low pressure condenser serving a pair of independent high pressure circuits each containing zero or more controlled or passive fluid splitters and mixers, one or more pressure pumps, one or more heat exchangers, and one or more expanders, and the means for controlling said apparatus.

2 Claims, 15 Drawing Sheets

(56) References Cited

U.S. PATENT DOCUMENTS 4,858,428 A * 8/1989 Paul ..... F02C 9/18 60/39.17
4,896,830 A 1/1990 Takamatsu
4,901,531 A 2/1990 Kubo et al.
4,911,110 A 3/1990 Isoda et al.
5,000,003 A 3/1991 Wicks
5,327,987 A * 7/1994 Abdelmalek ..... 180/65.25
5,754,613 A * 5/1998 Hashiguchi ..... F01K 25/065 376/378
5,794,447 A * 8/1998 Nicodemus ..... F01K 19/08 417/197
5,813,215 A * 9/1998 Weisser ..... 60/39.181
5,964,922 A * 10/1999 Keskar ..... B01D 53/22 95/288
6,058,695 A * 5/2000 Ranasinghe ..... F01K 23/10 60/39.182
6,125,631 A 10/2000 Hagglund
6,195,997 B1 * 3/2001 Lewis ..... F01K 25/065 60/648
6,216,459 B1 * 4/2001 Daudel et al. ..... 60/605.2
6,269,642 B1 8/2001 Arnold et al.
6,637,183 B2 * 10/2003 Viteri ..... F01K 21/047 60/39.182
6,857,268 B2 * 2/2005 Stinger ..... F01K 25/08 60/651
6,871,502 B2 * 3/2005 Marin ..... F01K 21/042 60/39.182
6,968,690 B2 * 11/2005 Kalina ..... F01K 25/065 60/649
7,254,949 B2 8/2007 Brasz et al.
7,278,264 B2 * 10/2007 Brostow ..... F01K 21/005 60/651
7,287,381 B1 * 10/2007 Pierson ..... F01K 25/08 60/651
8,117,844 B2 * 2/2012 Mirolli et al. ..... 60/649
2008/0066470 A1 * 3/2008 MacKnight ..... F01K 21/047 60/780
2008/0246281 A1 * 10/2008 Agrawal et al. ..... 290/52
2010/0071368 A1 * 3/2010 Kaplan ..... F01K 7/025 60/651
2010/0287934 A1 * 11/2010 Glynn ..... F01K 17/06 60/645
2010/0326076 A1 * 12/2010 Ast ..... F01K 23/04 60/671
2011/0016863 A1 * 1/2011 Ernst ..... 60/645
2011/0209474 A1 * 9/2011 Leibowitz ..... F01K 23/04 60/641.1

* cited by examiner

| | | Schematic | | | | |
|---|---|---|---|---|---|---|
| | | FIG 2 | FIG 3 | FIG 4 | FIG 5 | FIG 9 |
| Control Scheme | FIG 13 | X | X | X | X | X |
| | FIG 14 | X | X | X | X | X |
| | FIG 15 | X | X | X | X | X |
| | FIG 16 | X | X | X | X | X |
| | FIG 17 | X | X | X | X | X |
| | FIG 18 | | X | X | X | X |
| | FIG 19 | | | | | X |

FIG. 12

WASTE HEAT RECOVERY SYSTEM

CROSS-REFERENCE TO RELATED APPLICATIONS

This application claims the benefit of U.S. Provisional Application No. 61/244,106, filed on Sep. 21, 2009, the entirety of which is incorporated herein by reference.

BACKGROUND OF THE INVENTION

The present invention relates to a waste heat recovery system for combustion engines and a method of controlling said waste heat recovery system.

The continued reliance on high-cost diesel hydrocarbon fuel and the implementation of increasingly strict emission controls have had, and will continue to have, a significant impact on our society. These impacts include an increase in the cost of transporting goods (which, in turn, leads to increases in retail prices, i.e., inflation), increased global tensions (as a large fraction of known oil reserves are located in tumultuous regions of the globe), and increased cost of power generating systems, including vehicles, (due to the need to add ever more complex, and costly, exhaust treatment systems).

These impacts have not gone unnoticed and a variety of inventions have been disclosed to address them. For instance, hybrid-electric vehicles are currently gaining in popularity due to the increased mileage they provide. This is achieved by adding a temporary energy storage device, e.g. a battery, to the vehicle and using this device to decouple power production from power consumption, allowing each to operate in its optimal regime.

Another area that has received some focus is the extraction of additional useful energy from the 'waste' energy streams discharged from internal combustion engines. Typically, between 55% and 75% of all the heat energy of the fuel consumed in an internal combustion energy is not converted into useful energy and is dissipated to the surrounding environment. Given the magnitude of the energy entrained in these waste heat streams, a means for extracting additional useful energy from internal combustion engines is needed.

BRIEF SUMMARY OF THE INVENTION

In view of the disadvantages inherent in the known types of waste heat recovery systems now present in the prior art, the present disclosure provides an improved apparatus by employing a Rankine cycle working fluid which is capable of extracting most of the heat from the coolant fluid loops, thereby greatly reducing system complexity and cost while improving the efficiency and reliability.

The present invention discloses an apparatus for extracting useful work from a plurality of waste heat streams comprising a closed-loop flow path for a working fluid; a condenser; two high pressure circuits, in parallel, each comprising; a pump; a plurality of heat exchangers; and an expander; and a means for controlling said apparatus.

The present invention, while being applicable to any type of internal combustion engine, is particularly applicable to diesel-powered engines. In the recent past, the present invention would have been impractical for diesel-fueled engines, due to the presence of sulfur in diesel fuel, which would have rapidly fouled and significantly reduced the efficiency of the heat exchangers used by the present invention.

In addition, the higher efficiency of the diesel cycle, due to the higher compression ratio, results in a lower percentage of energy being wasted in the exhaust stream as compared to other heat energy waste streams, such as the engine cooling fluids. As such, the dual circuit of the present disclosure which extracts energy from these other heat energy waste streams takes on added importance. Furthermore, when an engine operates at a lower throttle setting (as compared to full throttle), the waste heat energy in the engine cooling fluid stream, as a percentage of total wasted heat energy, further increases, again increasing the advantages of the present invention.

Importantly, with the ever increasing availability of electric hybrid vehicles, the utilization of the captured power is greatly facilitated. In the past, it was required, at great expense and complexity, to add an electric motor to utilize the captured power. From the perspective of the present disclosure, hybrids are similar to locomotives and large diesel electric ships, in the sense that the electrical power generated can be easily incorporated into the existing system with little need for modification.

As compared to previously disclosed waste heat recovery systems, an advantage of the present invention is the elimination of additional heat exchangers required by said previously disclosed systems when the cycle could not absorb all of the jacket water heat energy or the charge air heat energy. The present invention employs a single working fluid with dual pressure circuits. This lowers the complexity, cost and weight by using a single condenser, condenser cooling circuit, working fluid reservoir, and low pressure control system. In one embodiments, the dual high pressure circuits allow for a low temperature and pressure boiling circuit to absorb all of the waste heat from the jacket water cooling media which has a peak temperature of approximately 95 C, and a second higher temperature and pressure boiling circuit to absorb the heat from the charge air and exhaust gas flows which reach temperatures up to 250 C and 600 C respectively. The higher temperature and pressure of the second circuit allows it to run at a thermal efficiency almost twice as high as the lower temperature system.

BRIEF DESCRIPTION OF THE DRAWINGS

The above, as well as other advantages of the present disclosure, will become readily apparent to those skilled in the art from the following detailed description, particularly when considered in the light of the drawings described below.

FIG. 12 provides a chart indicating which control schemes apply to which circuit schematic.

DETAILED DESCRIPTION OF THE INVENTION

Figure 1:
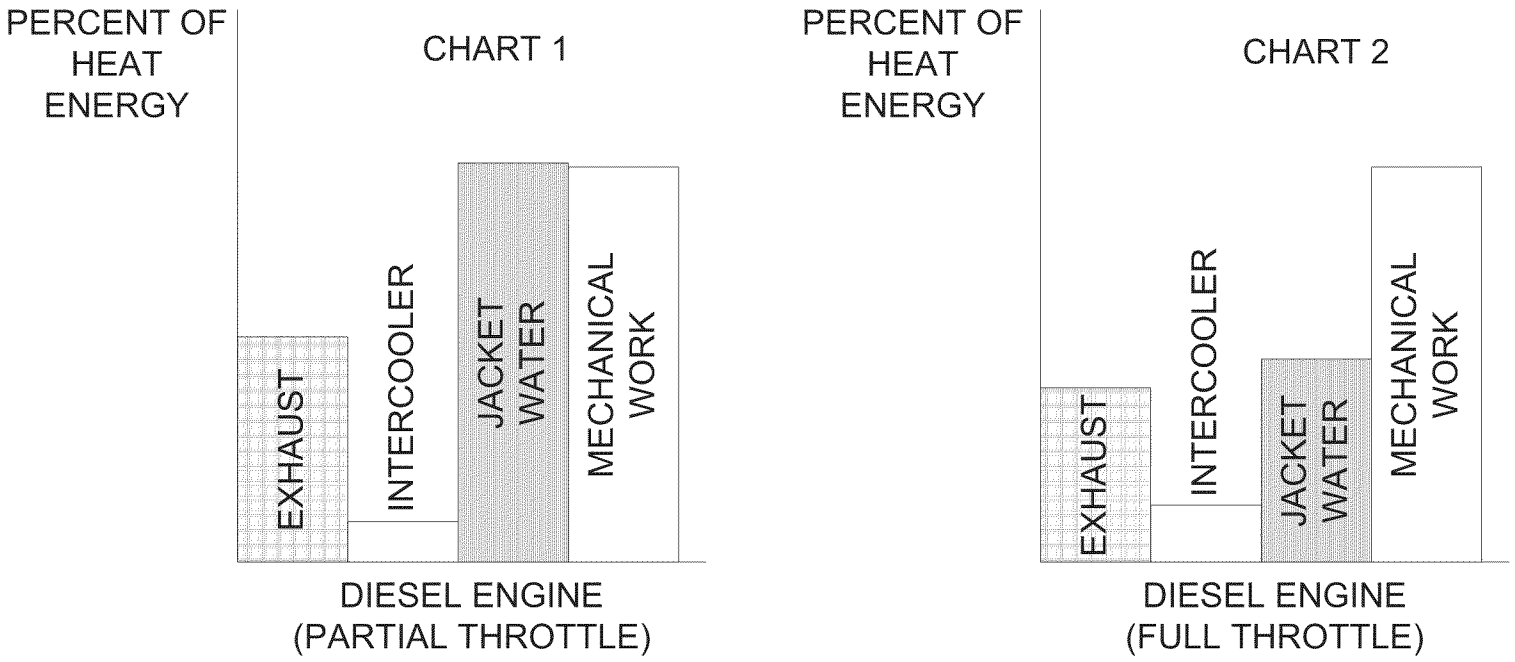
FIG. 1 illustrates the relative percentage of heat energy available in each of four streams for a prototypical diesel engine at partial and full throttle.

To facilitate an understanding of the present disclosure, a number of terms and phrases are defined below:

Heat engine: A combination of components used to extract useful energy from one or more heat sources.

Internal combustion engine (ICE): A device that produces mechanical power by internally combusting a mixture of atmospheric air and fuel. Among others, types of ICEs include piston operated engines and turbines. Piston operated engines may be spark or compression ignited. Fuels used by ICEs include gasoline, Diesel, alcohol, dimethyl ether, JP8, biodiesel, various blends, and the like.

Rankine cycle: A thermodynamic cycle used to create work from heat. It is accomplished by pressurizing a working fluid, heating it so that it at least partially vaporizes, and then expanding it through an expander to extract heat energy. After expansion, the working fluid is condensed again to run through the cycle. The Rankine cycle described in this application is a closed loop system that continuously reuses the working fluid.

Working fluid: A fluid used in a Rankine cycle. In this disclosure, it is typically referred to as Rankine Media or RM. In order to utilize a single fluid in those embodiments of the current disclosure with multiple RM loops while keeping the operating pressures in the heat exchangers less than 600 psi, a refrigeration type working fluid, such as R134a or R245fa, is typically employed. Such fluids are typically sensitive to damage from running at excessively high temperatures, such as those which may be experienced in a small portion of a heat exchanger circuit. Because the thermal efficiency is directly proportional to the expander inlet temperature, one goal of the control strategy is to have as high an expander inlet temperature as possible without exceeding the temperature, anywhere in the system, at which the working fluid is damaged.

Boiling point: The temperature at which a specific fluid boils as a function of pressure. Tables with boiling point and pressure are readily available for most common fluids, and can readily be developed for those fluids for which tables do not currently exist.

Waste heat stream: A fluid stream used to carry heat away from an internal combustion engine. Typical waste heat streams include: a jacket water stream, for engine block and head cooling, oil and/or fuel cooling; a charge air stream, for the heat of compression from engine superchargers; and an exhaust gas stream, which contains the left-over heat energy entrained in the products of combustion. For the purpose of this disclosure, a waste stream can be either the primary waste heat stream or a secondary stream which exchanges heat with the primary waste heat stream. For example, the waste heat stream which comprises the intercooler waste heat can be directly applied to an intercooler of the present invention or the waste heat stream which comprises the intercooler waste heat can be applied to an air-to-liquid heat exchanger and the heated liquid can then be applied to an intercooler of the present invention.

Jacket water heat exchanger: This cooling loop contains waste heat streams from one or more of the following—engine jacket water, oil cooler, fuel cooler, and/or first stage intercooler.

Expander: A device used to harness the thermodynamic energy in a flow of heated working gaseous fluid and convert it into shaft work. The heated working fluid flows through the expander from high pressure to low pressure while expanding. The accompanying temperature drop which occurs in this process is equal to the amount of shaft work generated minus the small amount of heat transferred to the material of the expander device. Expanders in Rankine systems are typically turbines, but they can also be some form of screw or reciprocating device. In the context of the present disclosure, an expander may include an optional, externally controlled, bypass valve which directs fluid from the inlet port to the outlet port without traversing the portion of the device in which energy is extracted, which can be used to prevent damage to the expander. In this disclosure, the shaft work generated is converted into electricity before being made available to the system. In this disclosure, the terms expander and turbine may be used interchangeably.

Variable geometry inlet: It is possible to vary the mass flow rate of working fluid through an expander and still be able to control the average upstream pressure maintained between the pressure pump and the turbine by the speed at which the expander rotates. In certain types of expanders, specifically radial flow turbines, changing the shape and size of the entry to the turbine that the working fluid sees as it approaches the turbine rotor is an additional mechanism for controlling this upstream pressure. This additional control can improve the efficiency of the turbine over a more broad range of pressure drops and mass flow rates, thereby providing an enhanced means for controlling the temperature at which the working fluid boils. Mechanisms for varying the mass flow rate have been previously disclosed. In the present disclosure, the concept of varying turbine inlet geometry refers to any means of controlling system pressure by controlling turbine operating parameters.

Look-up table: A look-up table (LUT) is a table with precalculated values which correspond to some equation (s). Typically, the LUT contains numerous values which correspond to some sampling of the inputs to the equation. It is also typical that interpolation routines are used to calculate intermediate values. Look-up tables can be replaced, with no change in functionality, by devices which calculate values in real-time. Additionally, a LUT may combine aspects of a traditional look-up table with devices which calculate values in real-time. As typically used in this disclosure, a LUT describes a relationship between input and output conditions for a device. It is also assumed, that an engine control unit may optionally communicate with a LUT, providing it various parameters, such as engine operating conditions, and that said parameters may be used as additional inputs to the LUT. Such relationship and the ability to describe them in LUT form are well known in the current art.

Set-point value: The value of an operating condition determined when a physical embodiment of the present disclosure is designed. For example, if damage to a fluid is known to start occurring at a particular temperature, the system designer may define a set-point temperature at some pre-determined temperature which is lower than the temperature at which damage may occur.

Control system: A combination of hardware, typically electric, and logic which causes certain output signals to be generated based on certain input signals. Typically, control system hardware incorporates a general purpose programmable processor, but could be as simple as number of relays connected in the appropriate manner. For purposes of the present disclosure, a control system is any hardware platform upon which the specific logic can be executed, having been expressed in any manner compatible with said hardware platform.

Fluid: Means any gas or liquid.

Storage tank: Also referred to simply as 'tank', a vessel, including necessary valving and pumps, to store fluid. The storage capacity of the tank may be sufficient to contain all media circulating in the system. In the present disclosure, the tank is shown being located at the output of the condenser, where the RM is at its lowest pressure and in the liquid phase where it will be pumped into and out of the RM circuit with the lowest amount of energy and the lightest, cheapest hardware. However, as will be apparent to one skilled in the art, the tank can be located at any point in the circuit and achieve the same result with insignificant changes to the tank control scheme.

Recuperator: A special purpose energy recovery heat exchanger, or a portion of a larger heat exchanger, used to transfer some of the leftover waste heat energy still remaining in the expanded RM exiting an expander to the RM in the high pressure circuit flowing towards the same expander. This typically is used to preheat the RM before it enters the boiling or superheating section. By preheating the RM with heat energy that was otherwise going to be rejected to the environment by the condenser, there is more high temperature and quality heat available for boiling and superheating and the system can now run a higher RM mass flow increasing the amount of energy that a Rankine cycle can extract from the same amount of waste heat energy.

Dry/wet type fluid: In the art of Rankine cycles, working fluids can be described as being one of two types; a wet fluid or a dry fluid. The difference between a wet and dry type fluid is the slope of the liquid/vapor saturation line on a Temperature-Entropy diagram. Water is an example of a wet type fluid. The slope of the fluid/vapor saturation line for a wet fluid is negative at all points. Refrigerants, such as R245fa, are examples of dry fluids. The slope of the fluid/vapor saturation line for a dry fluid is positive for a significant portion of the temperature range. To insure that 100% of the working fluid stays in the vapor phase all the way through to the exit of a turbine, a wet type fluid needs to be superheated to a temperature higher than its boiling point. A dry type fluid does not need this additional superheat and only needs to be heated until all of the liquid is vaporized at the boiling point.

Vehicle: A device designed or used to transport people or cargo. Example of vehicles include; cars, motorcycles, trains, ships, boats, aircraft, etc.

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical. In addition, while much of the present disclosure is illustrated using application to diesel electric locomotives examples, the present disclosure is not limited to these embodiments.

While it is well understood that waste heat is rejected from an engine via its exhaust, there are other significant sources of waste heat. Modern internal combustion engines are typically liquid cooled. Up to 35% of the heat energy in the fuel burned is rejected through the cylinder walls, cylinder head surface, oil cooler and fuel cooler. In an engine making 1 MW of power or more, this is a significant amount of heat to transfer and reject from the engine system. If an engine is supercharged, the intake air temperature is raised considerably, often increasing from 25 C to more than 200 C. The amount of heat energy added to the intake air, as heat, can approach 12% of the energy content of the fuel burned. This heat energy is typically expelled to the atmosphere through a charge air cooler, which is used to lower the intake air temperature back to temperatures typically less than 45 C. In the case of turbo-supercharging, the energy to compress and heat the intake gasses is extracted from the waste heat energy of the exhaust gasses. This transfer of heat from the exhaust stream to the intake stream lowers exhaust gas temperatures and further increases the proportion of recoverable heat energy that is not in the exhaust gases.

FIG. 1 includes Chart 1 and Chart 2, which illustrates the relative percentage of heat energy available in each of four streams for a prototypical Diesel engine at partial and full throttle, respectively, with the height of the bars being normalized such that the height of the mechanical work bar is the same for both charts. Although the present disclosure is not limited to Diesel engines, FIG. 1 clearly demonstrates an advantage of the present invention in Diesel engines.

Chart 1, partial throttle, shows that the fraction of heat energy which is wasted in the jacket water stream is actually greater than the fraction of heat energy which is used for useful mechanical work. Chart 2, full throttle, shows that the relative percentage of energy in the jacket water stream decreases at higher throttle.

Engines may have a single liquid cooling circuit or several circuits of cooling fluids, in some cases the cooling fluid could be air, as in an air-to-air charge air cooler. For exhaust gas recirculation (EGR) and charge air cooling, some systems use both a liquid cooled charge air cooler and an air-to-air charge air cooler. In a large diesel engine cooling system there are sometimes two liquid cooling circuits. The first circuit of a split cooling system is typically a higher return temperature cooling circuit in which the temperature of the cooling fluid changes only by a few degrees Celsius as it cycles through the engine and the cooling heat exchanger. This circuit typically services the jacket water system of the engine and may also service the oil cooler and fuel cooler. The primary purpose of this circuit is to remove the heat energy without dropping the temperature significantly. Typically the peak temperature of the cooling fluid will be 100 C and the return temperature from the heat exchanger to the ICE could be as high as 90 C. The second circuit of a split cooling system is typically a lower return temperature system in which the cooling media approaching the device to be cooled is significantly cooler than the device or media being cooled. Charge air cooling is a typical application in which the goal is to achieve a significant temperature drop in the media being cooled. With turbocharger compressor exit temperatures approaching 240 C and EGR cooler inlet temperatures approaching 500 C, the cooling media may see peak temperatures around 100 C similar to the higher return temp circuit, but the cooling fluid return temperature from the cooling heat exchanger will be as low as achievable from the system, with targets approaching 30 C. The magnitudes of the temperature differentials go from 10 C for the higher return temp to 70 C for the lower return temperature system.

A system which takes into account these differences, such as certain embodiments of the present disclosure, can maximize energy recovery as each of the recovery loops within the system can be tuned to extract the maximum amount of energy from each of the waste energy streams. A system which captures engine coolant fluid heat, in addition to exhaust heat, has a significant advantage at partial throttle settings.

U.S. Pat. No. 3,350,876 to Johnson describes an apparatus which uses water as the Rankine working fluid and harnesses only the heat energy of the exhaust gases. This system also uses a mechanical gear train between the expander and the engine to capture the recovered energy. Systems that mechanically connect the expander to the output shaft of the ICE force the rotational speed of the expander to be a function of rotational speed of the ICE's output shaft. This limits the speed range that the WHRS generates power to a very narrow band around the design point. As the ICE operating speed and load deviates from the design speed and load of the system, the power output decreases, at some point the WHRS will actually be absorbing mechanical energy from the output shaft of the ICE as it is forced to maintain an expander speed and system load point where the WHRS is not generating net power with the available waste heat energy available.

U.S. Pat. No. 4,334,409 to Daugas describes an apparatus which captures heat energy of the exhaust gases, heat energy of the jacket water coolant system, and the heat of compression in the pressurized charge air circuit. This system uses the jacket water and charge air cooler waste heat only to preheat the working fluid. It does not vaporize the working fluid, therefore the amount of heat which can be extract from the pressurized charge air and jacket water is limited to a small percentage of the available waste heat stream. This system still requires the cost, complexity and weight of the standard charge air cooler and jacket water cooler in addition to the heat exchangers of the waste heat recovery system. This preheating of the working fluid has a further disadvantage of reducing the amount of heat which can be absorbed from the exhaust gases. The working fluid in a heat exchanger can only extract heat from the exhaust gases up to the point that the exhaust gas exit temperature is a few degrees above the working fluid input temperature. If the jacket water and intercooler system preheat the working fluid from 30 C to 100 C then the exhaust gases will exit the WHRS system at a temperature a few degrees warmer than 100 C instead of exiting a few degrees warmer than the 30 C temperature at which the working fluid left the condenser. At reduced engine loads, when exhaust temperatures are in the 350 C range, the extra 70 C of temperature left in the exhaust gases could amount to over 30% more extractable energy rejected from the system as hotter exhaust gases.

The present disclosure addresses the short-comings identified in the prior art and provides additional unexpected results.

Basic Rankine cycles have two basic pressure zones for the flow of Rankine media, there is a low pressure zone that includes all the components from the exit of the last expander through the condenser and up to the first pump inlet and a high pressure zone from the last pump outlet to the first turbine inlet. In the high pressure zone, the Rankine media absorbs waste heat energy, which vaporizes and optionally superheats the fluid. Novel to the current disclosure is the combination of a single low pressure zone with dual high pressure zones with differing operating pressures. In one embodiment, the lower pressure, high pressure circuit will operate at a pressure at which the Rankine Media boils at approximately 95 C. For a specific embodiment in which R245fa is used as the RM, this circuit operates at a pressure of approximately 285 kPa. On the higher pressure, high pressure circuit, the final temperature of the RM is high enough that the RM may be pressurized to 4 MPa at which point the fluid is in a supercritical state and does not boil. When a substance is in its supercritical state, it is at a pressure and temperature past its critical point where there is no distinction between liquid and gas. When a substance is in a supercritical state, its temperature steadily increases as heat is added.

The distinct difference between the two independent high pressure circuits will be further clarified. The lower pressure, high pressure circuit, which is mainly dominated by the heat energy from the jacket water, is hereafter referred to as the lower temperature high pressure circuit or LTHP circuit. The higher pressure, high pressure circuit, which is mainly dominated by the heat energy of the ICE exhaust gasses, is hereafter referred to as the higher temperature high pressure circuit or HTHP circuit. As is standard, it is assumed that the pressure drop in the heat exchangers and lines is very small as compared to the pressure changes in the pumps and turbines and can therefore, for present purposes, be ignored.

Figure 2:
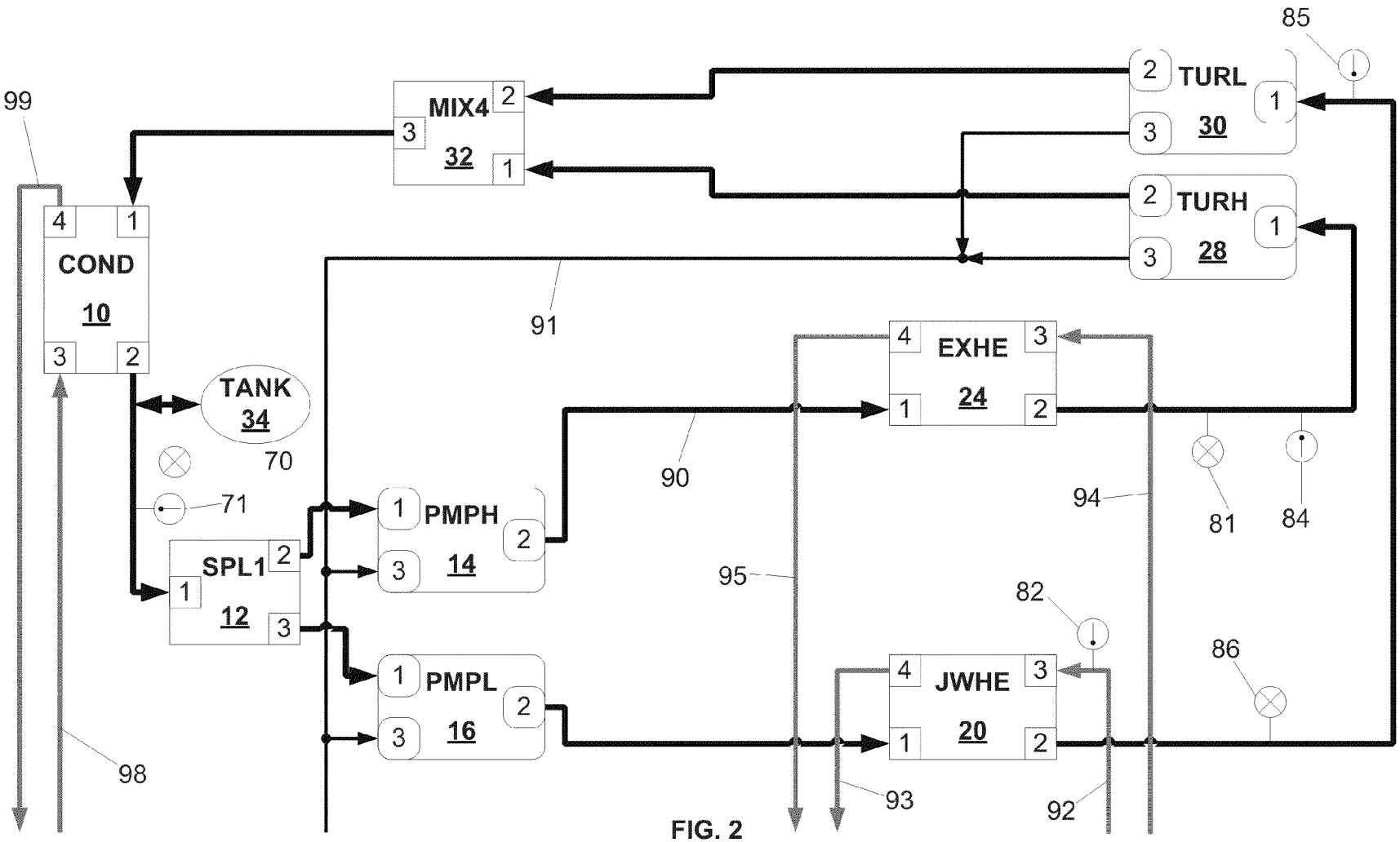
FIG. 2 illustrates in schematic a waste heat recovery system using a single condenser and two high pressure circuits, wherein each high pressure circuit has a single heat exchanger.

FIG. 2 shows a schematic of a waste heat recovery system using a single condenser and two high pressure circuits, wherein each high pressure circuit has a single heat exchanger. Rankine Media 90 circulates throughout the system, which is a closed-loop system. The description of the cycle arbitrarily starts with a heat exchanger 10.

The heat exchanger 10, hereafter Ambient Fluid Cooled Condenser (COND), takes in cool cooling media 98, typically ambient air, at inlet port 3 and after absorbing heat from the working fluid flowing through the opposite chamber of the heat exchanger, heated cooling media 99 exits COND 10 at outlet port 4, typically via discharge to the atmosphere. COND 10 inlet port 1 takes in superheated or mixed liquid/vapor RM 90. As RM 90 flows through COND 10, sufficient heat is extracted to cool it to a low enough temperature that it condenses to a liquid phase. Cooled, liquid RM 90 exits COND 10 at outlet port 2, from which it flows to inlet port 1 of a splitter 12, hereafter Splitter 1 (SPL1).

At some location between outlet port 2 of COND 10 and inlet port 1 of SPL1 12, is a connection to a tank 34, hereafter TANK.

Pressure sensor 70 measures the pressure of RM 90 as it exits COND 10 and is hereafter referred to as P_cond. Temperature sensor 71 measures the temperature of RM 90 as it exits COND 10 and is hereafter referred to as T_cond.

SPL1 12 is a passive device. Based on demand from the system pumps, a portion of RM 90 flows to outlet port 2, from which it flows to inlet port 1 of a pump 14, hereafter High Pressure Media Pump (PMPH). Remaining RM 90 flows to outlet port 3, from which it flows to inlet port 1 of a pump 16, hereafter Low Pressure Media Pump (PMPL).

Using electrical power taken from DC Bus 91, which enters PMPH 14 via inlet port 3, PMPH 14 pressurizes RM 90 to a working pressure and directs it to outlet port 2, from which it flows to inlet port 1 of a heat exchanger 24, hereafter Exhaust Heat Exchanger (EXHE).

EXHE 24 takes in cooled, pressurized RM 90 at inlet port 1 and after absorbing heat from the exhaust gas flowing through the opposite chamber of the heat exchanger, heated pressurized RM 90 exits EXHE 24 at outlet port 2, from which it flows to inlet port 1 of a turbine 28, hereafter High Pressure Turbine (TURH). EXHE 24 inlet port 3 takes in heated, typically clean, exhaust gas 94. As exhaust gas 94 flows through EXHE 24, sufficient heat is extracted to cause RM 90 to become superheated vapor. Cooled exhaust gas 95 exits EXHE 24 at outlet port 4, from which it is typically discharged to the atmosphere.

Pressure sensor 81 measures the pressure of RM 90 in the HTHP circuit and is hereafter referred to as P_hthp. Temperature sensor 84 measures the temperature of RM 90 as it enters TURH 28 and is hereafter referred to as T_turh.

Superheated RM 90 is expanded in TURH 28 which converts a portion of the thermodynamic energy contained within the working fluid to electrical energy, which is provided to DC Bus 91 via outlet port 3. RM 90, now at a lower pressure and temperature, exits TURH 28 at outlet port 2 from which it flows to inlet port 2 of a passive mixer 32, hereafter Mixer 4 (MIX4).

Using electrical power taken from DC Bus 91, which enter PMPL 16 via inlet port 3, PMPL 16 pressurizes RM 90 to a working pressure and directs it to outlet port 2, from which it flows to inlet port 1 of a heat exchanger 20, hereafter Jacket Water Heat Exchanger (JWHE).

JWHE 20 takes in cooled, pressurized RM 90 at inlet port 1 and after absorbing heat energy from the jacket water cooling fluid flowing through the opposite chamber of the heat exchanger, heated pressurized RM 90 exits JWHE 20 at outlet port 2, from which it flows to inlet port 1 of a turbine 30, hereafter Low Pressure Turbine (TURL). JWHE 20 inlet port 3 takes in heated jacket water cooling fluid 92. As jacket water cooling fluid flows through JWHE 20, sufficient heat is extracted to cause RM 90 to become superheated vapor. Cooled jacket water cooling fluid 93 exits JWHE 20 at outlet port 4, from which it is returned to the engine in a closed-loop manner.

Pressure sensor 86 measures the pressure of RM 90 in the LTHP circuit and is hereafter referred to as P_lthp. Temperature sensor 85 measures the temperature of RM 90 as it enters TURL 30 and is hereafter referred to as T_turl. Temperature sensor 82 measures the temperature of heated jacket water cooling fluid 92 as it enters JWHE 20 and is hereafter referred to as T_eng.

Superheated RM 90 is expanded in TURL 30 which converts a portion of the thermodynamic energy contained within the working fluid to electrical energy, which is provided to DC Bus 91 via outlet port 3. RM 90, now at a lower pressure and temperature, exits TURL 30 at outlet port 2 from which it flows to inlet port 2 of MIX4 32.

MIX4 32 combines the two streams of RM 90 from inlet ports 1 and 2 and sends combined stream to inlet port 1 of COND 10, thus completing the closed loop of the Rankine cycle.

The closed loop system described creates net electrical power, that is, the sum of the power generated by TURH 28 and TURL 30 is greater than the sum of the power consumed by PMPH 14 PMPL 16, and other necessary devices, such as a control system, valves, etc. DC Bus 91 is electrically connected to the electrical bus of the system into which the waste heat recovery system described herein is mounted, thus, the power generated is available for system use.

Figure 3:
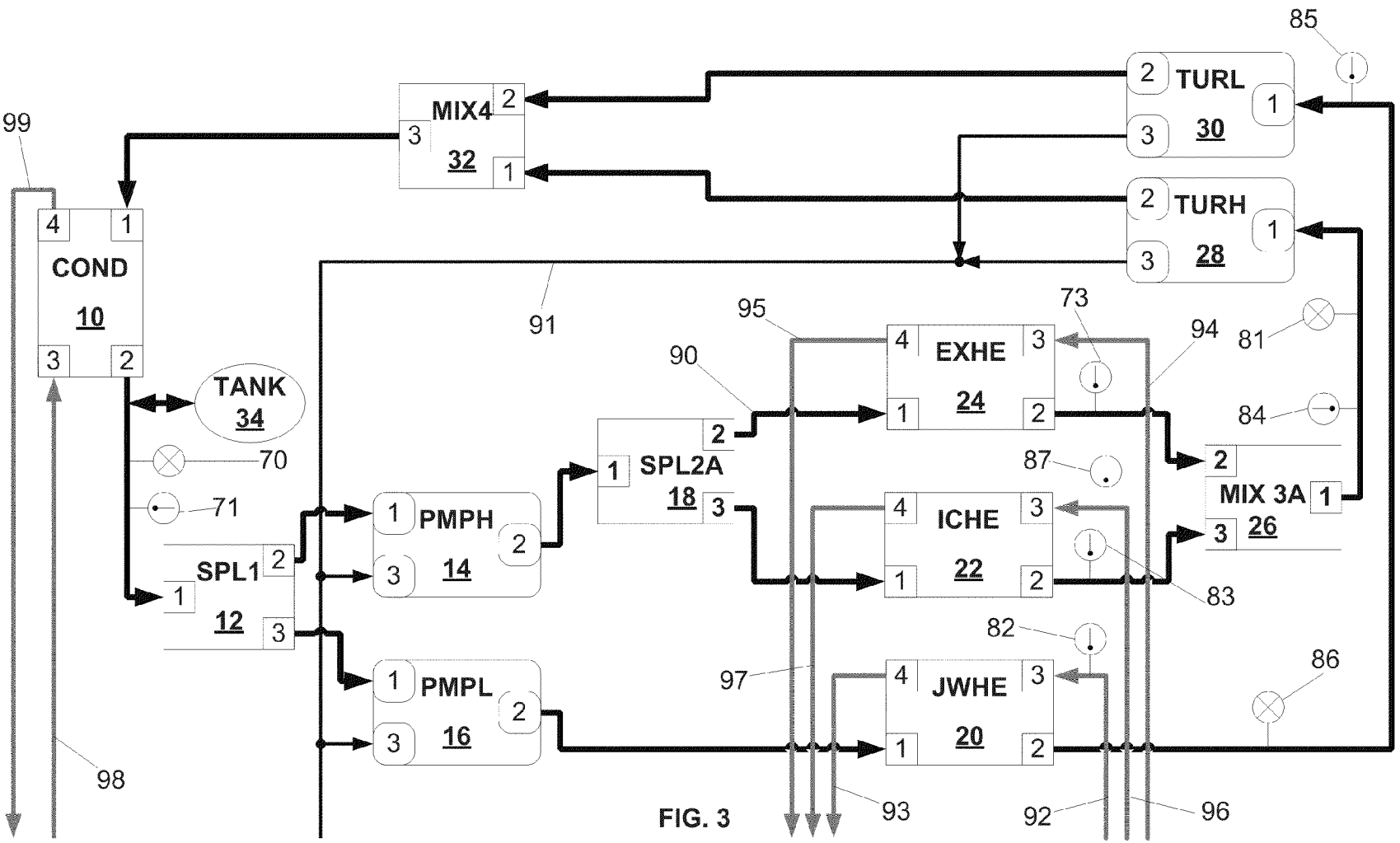
FIG. 3 illustrates in schematic a waste heat recovery system using a single condenser and two high pressure circuits, wherein the first high pressure circuit has a pair of heat exchangers in parallel and the second high pressure circuit has a single heat exchanger.

FIG. 3 shows a schematic of a waste heat recovery system using a single condenser and two high pressure circuits, wherein the HTHP circuit has a pair of heat exchangers in parallel and the LTHP circuit has a single heat exchanger. Rankine media 90 circulates throughout the system, which is a closed-loop system. The description of the cycle arbitrarily starts with a heat exchanger 10.

The heat exchanger 10, hereafter Ambient Fluid Cooled Condenser (COND), takes in cool cooling media 98, typically ambient air, at inlet port 3 and after absorbing heat from the working fluid flowing through the opposite chamber of the heat exchanger, heated cooling media 99 exits COND 10 at outlet port 4, typically via discharge to the atmosphere. COND 10 inlet port 1 takes in superheated or mixed liquid/vapor RM 90. As RM 90 flows through COND 10, sufficient heat is extracted to cool it to a low enough temperature that it condenses to a liquid phase. Cooled, liquid RM 90 exits COND 10 at outlet port 2, from which it flows to inlet port 1 of a splitter 12, hereafter Splitter 1 (SPL1).

At some location between outlet port 2 of COND 10 and inlet port 1 of SPL1 12, is a connection to a tank 34, hereafter TANK.

Pressure sensor 70 measures the pressure of RM 90 as it exits COND 10 and is hereafter referred to as P_cond. Temperature sensor 71 measures the temperature of RM 90 as it exits COND 10 and is hereafter referred to as T_cond.

SPL1 12 is a passive device. Based on demand from the system pumps, a portion of RM 90 flows to outlet port 2, from which it flows to inlet port 1 of a pump 14, hereafter High Pressure Media Pump (PMPH). Remaining RM 90 flows to outlet port 3, from which it flows to inlet port 1 of a pump 16, hereafter Low Pressure Media Pump (PMPL).

Using electrical power taken from DC Bus 91, which enters PMPH 14 via inlet port 3, PMPH 14 pressurizes RM 90 to a working pressure and directs it to outlet port 2, from which it flows to inlet port 1 of a splitter 18, hereafter Splitter 2A (SPL2A).

SPL2A 18 is a controlled device. Based on a signal from the control system, a portion of RM 90 is directed to outlet port 2, from which it flows to inlet port 1 of a heat exchanger 24, hereafter Exhaust Heat Exchanger (EXHE). Remaining RM 90 is directed to outlet port 3, from which it flows to inlet port 1 of a heat exchanger 22, hereafter Intercooler Heat Exchanger (ICHE).

EXHE 24 takes in cooled, pressurized RM 90 at inlet port 1 and after absorbing heat from the exhaust gas flowing through the opposite chamber of the heat exchanger, heated pressurized RM 90 exits EXHE 24 at outlet port 2, from which it flows to inlet port 1 of a mixer 26, hereafter Mixer 3A (MIX3A). EXHE 24 inlet port 3 takes in heated, typically clean, exhaust gas 94. As exhaust gas flows through EXHE 24, sufficient heat is extracted to cause RM 90 to become superheated vapor. Cooled exhaust gas 95 exits EXHE 24 at outlet port 4, from which it is typically discharged to the atmosphere.

ICHE 22 takes in cooled, pressurized RM 90 at inlet port 1 and after absorbing heat from the charge air flowing through the opposite chamber of the heat exchanger, heated pressurized RM 90 exits ICHE 22 at outlet port 2, from which it flows to inlet port 2 of MIX3 26. ICHE 22 inlet port 3 takes in heated charge air 96. As charge air flows through ICHE 22, sufficient heat is extracted to cause RM 90 to become superheated vapor. Cooled charge air 97 exits ICHE 22 at outlet port 4, from which it is returned to the engine.

MIX3A 26 combines the two streams of working fluid from inlet ports 1 and 2 and sends combined stream to inlet port 1 of a turbine 28, hereafter High Pressure Turbine (TURH).

As described, SPL2A 18 is an controlled device and MIX3A 26 is a passive device. A completely equivalent embodiment replaces SPL2A 18 with a passive splitter and MIX3A 26 with an controlled mixer.

Pressure sensor 81 measures the pressure of RM 90 in the HTHP circuit and is hereafter referred to as P_hthp. Temperature sensor 84 measures the temperature of RM 90 as it enters TURH 28 and is hereafter referred to as T_turh. Temperature sensor 87 measures the temperature of heated charge air 96 as it enters ICHE 24 and is hereafter referred to as T_charge. Temperature sensor 83 measures the temperature of RM 90 as it exits ICHE 22 and is hereafter referred to as T_iche. Temperature sensor 73 measures the temperature of RM 90 as it exits EXHE 24 and is hereafter referred to as T_exhe. Note that only two of temperature sensors 73, 83, or 84 are needed as the temperature of the third can be calculated from the other two.

Superheated RM 90 is expanded in TURH 28 which converts a portion of the thermodynamic energy contained within the working fluid to electrical energy, which is provided to DC Bus 91 via outlet port 3. RM 90, now at a lower pressure and temperature, exits TURH 28 at outlet port 2 from which it flows to inlet port 2 of a passive mixer 32, hereafter Mixer 4 (MIX4).

Using electrical power taken from DC Bus 91, which enter PMPL 16 via inlet port 3, PMPL 16 pressurizes RM 90 to a working pressure and directs it to outlet port 2, from which it flows to inlet port 1 of a heat exchanger 20, hereafter Jacket Water Heat Exchanger (JWHE).

JWHE 20 takes in cooled, pressurized RM 90 at inlet port 1 and after absorbing heat from the jacket water cooling fluid flowing through the opposite chamber of the heat exchanger, heated pressurized RM 90 exits JWHE 20 at outlet port 2, from which it flows to inlet port 1 of a turbine 30, hereafter Low Pressure Turbine (TURL). JWHE 20 inlet port 3 takes in heated jacket water cooling fluid 92. As jacket water cooling fluid flows through JWHE 20, sufficient heat is extracted to cause RM 90 to become superheated vapor. Cooled jacket water cooling fluid 93 exits JWHE 20 at outlet port 4, from which it is returned to the engine in a closed-loop manner.

Pressure sensor 86 measures the pressure of RM 90 in the LTHP circuit and is hereafter referred to as P_lthp. Temperature sensor 85 measures the temperature of RM 90 as it enters TURL 30 and is hereafter referred to as T_turl. Temperature sensor 82 measures the temperature of heated jacket water cooling fluid 92 as it enters JWHE 20 and is hereafter referred to as T_eng.

Superheated RM 90 is expanded in TURL 30 which converts a portion of the thermodynamic energy contained within the working fluid to electrical energy, which is provided to DC Bus 91 via outlet port 3. RM 90, now at a lower pressure and temperature, exits TURL 30 at outlet port 2 from which it flows to inlet port 2 of MIX4 32.

MIX4 32 combines the two streams of working fluid from inlet ports 1 and 2 and sends combined stream to inlet port 1 of COND 10, thus completing the closed loop of the Rankine cycle.

The closed loop system described creates net electrical power, that is, the sum of the power generated by TURH 28 and TURL 30 is greater than the sum of the power consumed by PMPH 14 PMPL 16, and other necessary devices, such as a control system, valves, etc. DC Bus 91 is electrically connected to the electrical bus of the system into which the waste heat recovery system described herein is mounted, thus, the power generated is available for system use.

Figure 4:
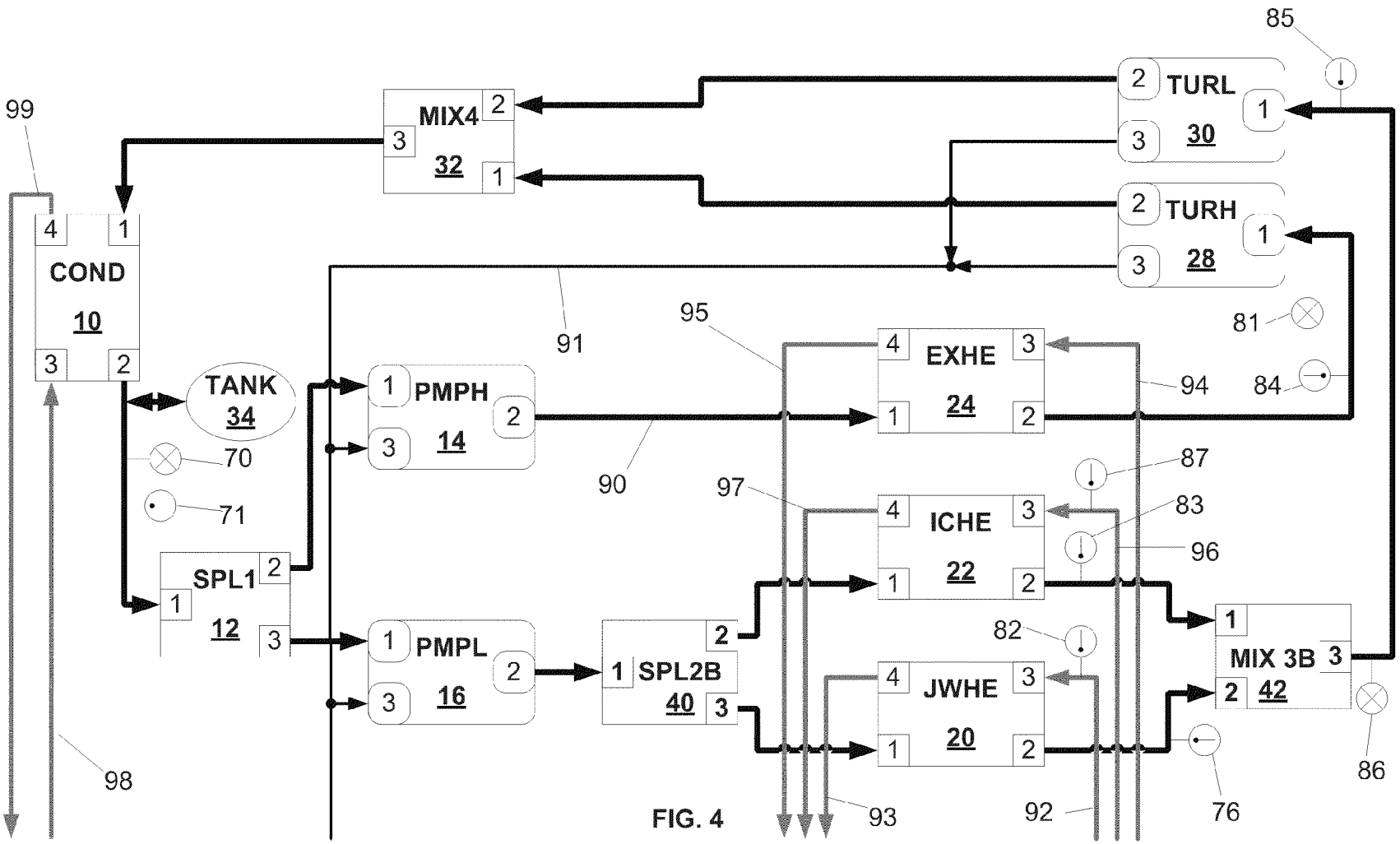
FIG. 4 illustrates in schematic a waste heat recovery system using a single condenser and two high pressure circuits, wherein the first high pressure circuit has a single heat exchanger and the second high pressure circuit has a pair of heat exchangers in parallel.

FIG. 4 shows a schematic of a waste heat recovery system using a single condenser and two high pressure circuits, wherein the HTHP circuit has a single heat exchanger and the LTHP circuit has a pair of heat exchangers in parallel. Rankine media 90 circulates throughout the system, which is a closed-loop system. The description of the cycle arbitrarily starts with a heat exchanger 10.

The heat exchanger 10, hereafter Ambient Fluid Cooled Condenser (COND), takes in cool cooling media 98, typically ambient air, at inlet port 3 and after absorbing heat from the working fluid flowing through the opposite chamber of the heat exchanger, heated cooling media 99 exits COND 10 at outlet port 4, typically via discharge to the atmosphere. COND 10 inlet port 1 takes in superheated or mixed liquid/vapor RM 90. As RM 90 flows through COND 10, sufficient heat is extracted to cool it to a low enough temperature that it condenses to a liquid phase. Cooled, liquid RM 90 exits COND 10 at outlet port 2, from which it flows to inlet port 1 of a splitter 12, hereafter Splitter 1 (SPL1).

At some location between outlet port 2 of COND 10 and inlet port 1 of SPL1 12, is a connection to a tank 34, hereafter TANK.

Pressure sensor 70 measures the pressure of RM 90 as it exits COND 10 and is hereafter referred to as P_cond. Temperature sensor 71 measures the temperature of RM 90 as it exits COND 10 and is hereafter referred to as T_cond.

SPL1 12 is a passive device. Based on demand from the system pumps, a portion of RM 90 flows to outlet port 2, from which it flows to inlet port 1 of a pump 14, hereafter High Pressure Media Pump (PMPH). Remaining RM 90 flows to outlet port 3, from which it flows to inlet port 1 of a pump 16, hereafter Low Pressure Media Pump (PMPL).

Using electrical power taken from DC Bus 91, which enters PMPH 14 via inlet port 3, PMPH 14 pressurizes RM 90 to a working pressure and directs it to outlet port 2, from which it flows to inlet port 1 of a heat exchanger 24, hereafter Exhaust Heat Exchanger (EXHE).

EXHE 24 takes in cooled, pressurized RM 90 at inlet port 1 and after absorbing heat from the exhaust gas flowing through the opposite chamber of the heat exchanger, heated pressurized RM 90 exits EXHE 24 at outlet port 2, from which it flows to inlet port 1 of a turbine 28, hereafter High Pressure Turbine (TURH). EXHE 24 inlet port 3 takes in heated, typically clean, exhaust gas 94. As exhaust gas 94 flows through EXHE 24, sufficient heat is extracted to cause RM 90 to become superheated vapor. Cooled exhaust gas 95 exits EXHE 24 at outlet port 4, from which it is typically discharged to the atmosphere.

Pressure sensor 81 measures the pressure of RM 90 in the HTHP circuit and is hereafter referred to as P_hthp. Temperature sensor 84 measures the temperature of RM 90 as it enters TURH 28 and is hereafter referred to as T_turh.

Superheated RM 90 is expanded in TURH 28 which converts a portion of the thermodynamic energy contained within the working fluid to electrical energy, which is provided to DC Bus 91 via outlet port 3. RM 90, now at a lower pressure and temperature, exits TURH 28 at outlet port 2 from which it flows to inlet port 2 of a passive mixer 32, hereafter Mixer 4 (MIX4).

Using electrical power taken from DC Bus 91, which enter PMPL 16 via inlet port 3, PMPL 16 pressurizes RM 90 to a working pressure and directs it to outlet port 2, from which it flows to inlet port 1 of a splitter 40, hereafter Splitter 2B (SPL2B).

SPL2B is a controlled device. Based on a signal from the control system, a portion of RM 90 is directed to outlet port 2, from which it flows to inlet port 1 of a heat exchanger 22, hereafter Intercooler Heat Exchanger (ICHE). Remaining RM 90 is directed to outlet port 3, from which it flows to inlet port 1 of a heat exchanger 20, hereafter Jacket Water Heat Exchanger (JWHE).

ICHE 22 takes in cooled, pressurized RM 90 at inlet port 1 and after absorbing heat from the charge air flowing through the opposite chamber of the heat exchanger, heated pressurized RM 90 exits ICHE 22 at outlet port 2, from which it flows to inlet port 1 of a mixer 42, hereafter Mixer 3B (MIX3B). ICHE 22 inlet port 3 takes in heated charge air 96. As charge air flows through ICHE 22, sufficient heat is extracted to cause RM 90 to become superheated vapor. Cooled charge air 97 exits ICHE 22 at outlet port 4, from which it is returned to the engine.

JWHE 20 takes in cooled, pressurized RM 90 at inlet port 1 and after absorbing heat from the jacket water cooling fluid flowing through the opposite chamber of the heat exchanger, heated pressurized RM 90 exits JWHE 20 at outlet port 2, from which it flows to inlet port 2 of MIX3B 42. JWHE 20 inlet port 3 takes in heated jacket water cooling fluid 92. As jacket water cooling fluid flows through JWHE 20, sufficient heat is extracted to cause RM 90 to become superheated vapor. Cooled jacket water cooling fluid 93 exits JWHE 20 at outlet port 4, from which it is returned to the engine in a closed-loop manner.

MIX3B 42 combines the two streams of working fluid from inlet ports 1 and 2 and sends combined stream to inlet port 1 of a turbine 30, hereafter Low Pressure Turbine (TURL).

As shown, SPL2B 40 is a controlled device and MIX3B 42 is a passive device. A completely equivalent embodiment replaces SPL2B 40 with a passive splitter and MIX3B 42 with a controlled mixer.

Pressure sensor 86 measures the pressure of RM 90 in the LTHP circuit and is hereafter referred to as P_lthp. Temperature sensor 85 measures the temperature of RM 90 as it enters TURL 30 and is hereafter referred to as T_turl. Temperature sensor 82 measures the temperature of heated jacket water cooling fluid 92 as it enters JWHE 20 and is hereafter referred to as T_eng. Temperature sensor 87 measures the temperature of heated charge air 96 as it enters ICHE 24 and is hereafter referred to as T_charge. Temperature sensor 83 measures the temperature of RM 90 as it exits ICHE 22 and is hereafter referred to as T_iche. Temperature sensor 76 measures the temperature of RM 90 as it exits JWHE 20 and is hereafter referred to as T_jwhe. Note that only two of temperature sensors 76, 83, or 86 are needed as the temperature of the third can be calculated from the other two.

Superheated RM 90 is expanded in TURL 30 which converts a portion of the thermodynamic energy contained within the working fluid to electrical energy, which is provided to DC Bus 91 via outlet port 3. RM 90, now at a lower pressure and temperature, exits TURL 30 at outlet port 2 from which it flows to inlet port 2 of MIX4 32.

MIX4 32 combines the two streams of working fluid from inlet ports 1 and 2 and sends combined stream to inlet port 1 of COND 10, thus completing the closed loop of the Rankine cycle.

The closed loop system described creates net electrical power, that is, the sum of the power generated by TURH 28 and TURL 30 is greater than the sum of the power consumed by PMPH 14 PMPL 16, and other necessary devices, such as a control system, valves, etc. DC Bus 91 is electrically connected to the electrical bus of the system into which the waste heat recovery system described herein is mounted, thus, the power generated is available for system use.

Figure 5:
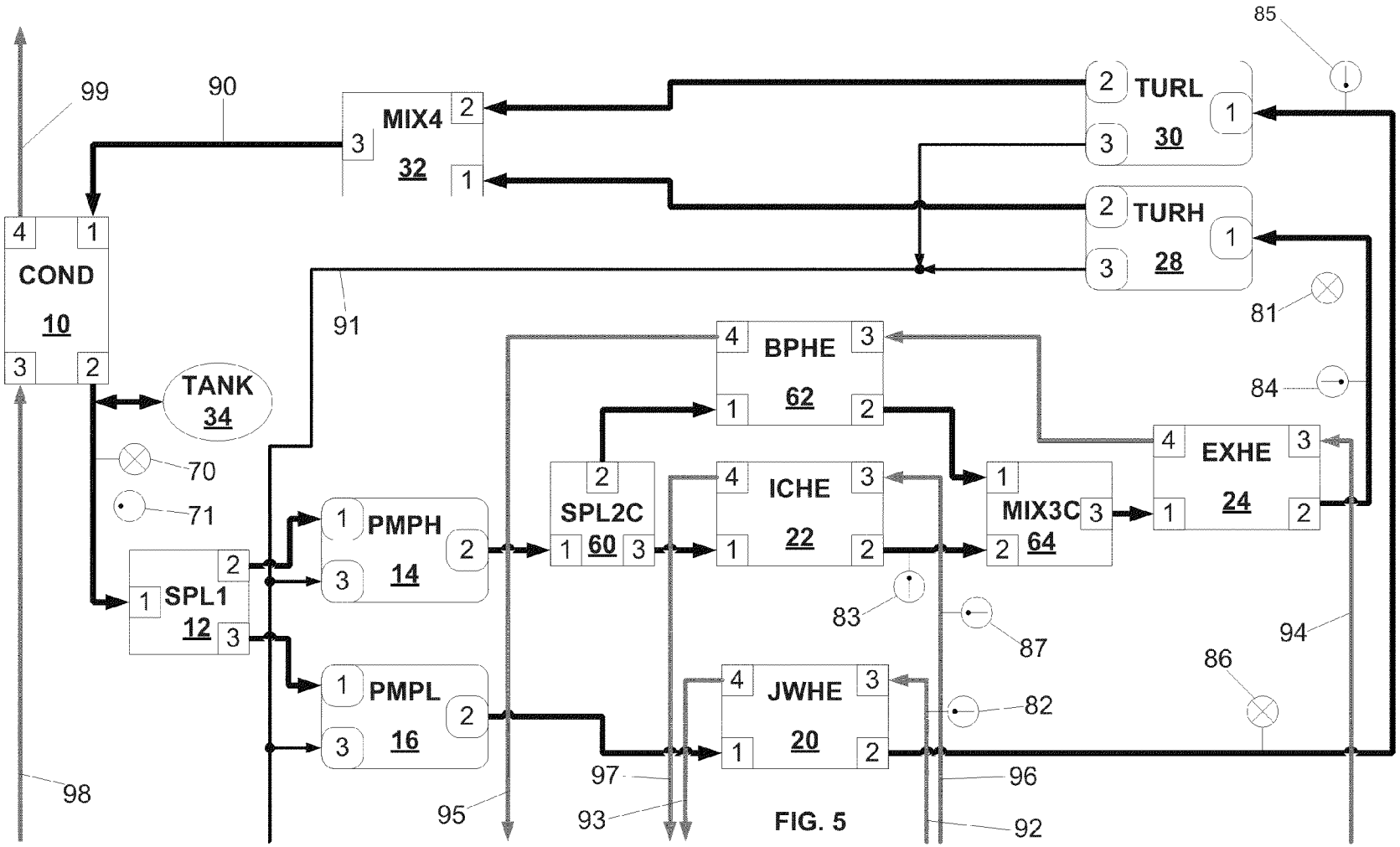
FIG. 5 illustrates in schematic a system using a single condenser with two pressure circuits, wherein the first high pressure circuit has two parallel heat exchangers in series with a third heat exchanger and the second high pressure circuit has a single heat exchanger.

FIG. 5 shows a schematic of a system using a single condenser with two pressure circuits, wherein the HTHP circuit has two parallel heat exchangers in series with a third heat exchanger and the LTHP circuit has a single heat exchanger. Rankine media 90 circulates throughout the system, which is a closed-loop system. The description of the cycle arbitrarily starts with a heat exchanger 10.

The heat exchanger 10, hereafter Ambient Fluid Cooled Condenser (COND), takes in cool cooling media 98, typically ambient air, at inlet port 3 and after absorbing heat from the working fluid flowing through the opposite chamber of the heat exchanger, heated cooling media 99 exits COND 10 at outlet port 4, typically via discharge to the atmosphere. COND 10 inlet port 1 takes in superheated or mixed liquid/vapor RM 90. As RM 90 flows through COND 10, sufficient heat is extracted to cool it to a low enough temperature that it condenses to a liquid phase. Cooled, liquid RM 90 exits COND 10 at outlet port 2, from which it flows to inlet port 1 of a splitter 12, hereafter Splitter 1 (SPL1).

At some location between outlet port 2 of COND 10 and inlet port 1 of SPL1 12, is a connection to a tank 34, hereafter TANK.

Pressure sensor 70 measures the pressure of RM 90 as it exits COND 10 and is hereafter referred to as P_cond. Temperature sensor 71 measures the temperature of RM 90 as it exits COND 10 and is hereafter referred to as T_cond.

SPL1 12 is a passive device. Based on demand from the system pumps, a portion of RM 90 flows to outlet port 2, from which it flows to inlet port 1 of a pump 14, hereafter High Pressure Media Pump (PMPH). Remaining RM 90 flows to outlet port 3, from which it flows to inlet port 1 of a pump 16, hereafter Low Pressure Media Pump (PMPL).

Using electrical power taken from DC Bus 91, which enters PMPH 14 via inlet port 3, PMPH 14 pressurizes RM 90 to a working pressure and directs it to outlet port 2, from which it flows to inlet port 1 of a splitter 60, hereafter Splitter 2C (SPL2C).

SPL2C 60 is a controlled device. Based on a signal from the control system, a portion of RM 90 is directed to outlet port 2, from which it flows to inlet port 1 of a heat exchanger 62, hereafter Bypass Heat Exchanger (BPHE). Remaining RM 90 is directed to outlet port 3, from which it flows to inlet port 1 of a heat exchanger 22, hereafter Intercooler Heat Exchanger (ICHE).

BPHE 62 takes in cooled, pressurized RM 90 at inlet port 1 and after absorbing heat from the exhaust gas flowing through the opposite chamber of the heat exchanger, heated pressurized RM 90 exits BPHE 62 at outlet port 2, from which it flows to inlet port 1 of a mixer 64, hereafter Mixer 3C (MIX3C). BPHE 62 inlet port 3 takes in partially cooled exhaust gas 94. As exhaust gas flows through BPHE 62, heat is extracted to cause RM 90 to become hotter. Cooled exhaust gas 95 exits BPHE 62 at outlet port 4, from which it is typically discharged to the atmosphere.

ICHE 22 takes in cooled, pressurized RM 90 at inlet port 1 and after absorbing heat from the charge air flowing through the opposite chamber of the heat exchanger, heated pressurized RM 90 exits ICHE 22 at outlet port 2, from which it flows to inlet port 2 of MIX3C 64. ICHE 22 inlet port 3 takes in heated charge air 96. As charge air flows through ICHE 22, heat is extracted to cause RM 90 to become hotter. Cooled charge air 97 exits ICHE 22 at outlet port 4, from which it is returned to the engine.

MIX3C 64 combines the two streams of working fluid from inlet ports 1 and 2 and sends combined stream to inlet port 1 of a heat exchanger 24, hereafter Exhaust Heat Exchanger (EXHE).

EXHE 24 takes in warm pressurized RM 90 at inlet port 1 and after absorbing heat from the exhaust gas flowing through the opposite chamber of the heat exchanger, heated pressurized RM 90 exits EXHE 24 at outlet port 2, from which it flows to inlet port 1 of a turbine 28, hereafter High Pressure Turbine (TURH). EXHE 24 inlet port 3 takes in heated, typically clean, exhaust gas 94. As exhaust gas 94 flows through EXHE 24, sufficient heat is extracted to cause RM 90 to become superheated vapor. Cooler exhaust gas 94 exits EXHE 24 at outlet port 4, from which it flows into inlet port 3 of BPHE 62.

As shown, SPL2C 60 is a controlled device and MIX3C 64 is a passive device. A completely equivalent embodiment replaces SPL2C 60 with a passive splitter and MIX3C 64 with a controlled mixer.

Pressure sensor 81 measures the pressure of RM 90 in the HTHP and is hereafter referred to as P_hthp. Temperature sensor 84 measures the temperature of RM 90 as it enters TURH 28 and is hereafter referred to as T_turh. Temperature sensor 83 measures the temperature of RM 90 as it exits ICHE 22 and is hereafter referred to as T_iche. Temperature sensor 87 measures the temperature of heated charge air 96 as it enters ICHE 24 and is hereafter referred to as T_charge.

Superheated RM 90 is expanded in TURH 28 which converts a portion of the thermodynamic energy contained within the working fluid to electrical energy, which is provided to DC Bus 91 via outlet port 3. RM 90, now at a lower pressure and temperature, exits TURH 28 at outlet port 2 from which it flows to inlet port 2 of a passive mixer 32, hereafter Mixer 4 (MIX4).

Using electrical power taken from DC Bus 91, which enter PMPL 16 via inlet port 3, PMPL 16 pressurizes RM 90 to a working pressure and directs it to outlet port 2, from which it flows to inlet port 1 of a heat exchanger 20, hereafter Jacket Water Heat Exchanger (JWHE).

JWHE 20 takes in cooled, pressurized RM 90 at inlet port 1 and after absorbing heat from the jacket water cooling fluid flowing through the opposite chamber of the heat exchanger, heated pressurized RM 90 exits JWHE 20 at outlet port 2, from which it flows to inlet port 1 of a turbine 30, hereafter Low Pressure Turbine (TURL). JWHE 20 inlet port 3 takes in heated jacket water cooling fluid 92. As jacket water cooling fluid flows through JWHE 20, sufficient heat is extracted to cause RM 90 to become superheated vapor. Cooled jacket water cooling fluid 93 exits JWHE 20 at outlet port 4, from which it is returned to the engine in a closed-loop manner.

Pressure sensor 86 measures the pressure of RM 90 in the LTHP and is hereafter referred to as P_lthp. Temperature sensor 85 measures the temperature of RM 90 as it enters TURL 30 and is hereafter referred to as T_turl. Temperature sensor 82 measures the temperature of heated jacket water cooling fluid 92 as it enters JWHE 20 and is hereafter referred to as T_eng.

Superheated RM 90 is expanded in TURL 30 which converts a portion of the thermodynamic energy contained within the working fluid to electrical energy, which is provided to DC Bus 91 via outlet port 3. RM 90, now at a lower pressure and temperature, exits TURL 30 at outlet port 2 from which it flows to inlet port 2 of MIX4 32.

MIX4 32 combines the two streams of working fluid from inlet ports 1 and 2 and sends combined stream to inlet port 1 of COND 10, thus completing the closed loop of the Rankine cycle.

The closed loop system described creates net electrical power, that is, the sum of the power generated by TURH 28 and TURL 30 is greater than the sum of the power consumed by PMPH 14 PMPL 16, and other necessary devices, such as a control system, valves, etc. DC Bus 91 is electrically connected to the electrical bus of the system into which the waste heat recovery system described herein is mounted, thus, the power generated is available for system use.

Figure 6:
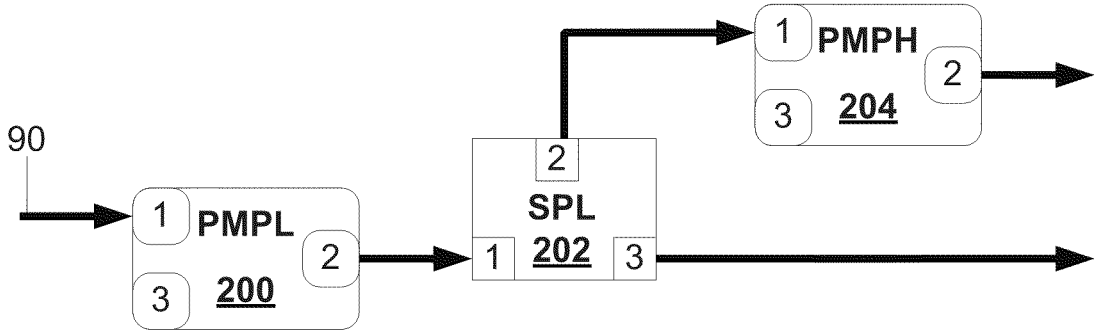
FIG. 6 illustrates a series configuration for the media pumps.
Figure 7:
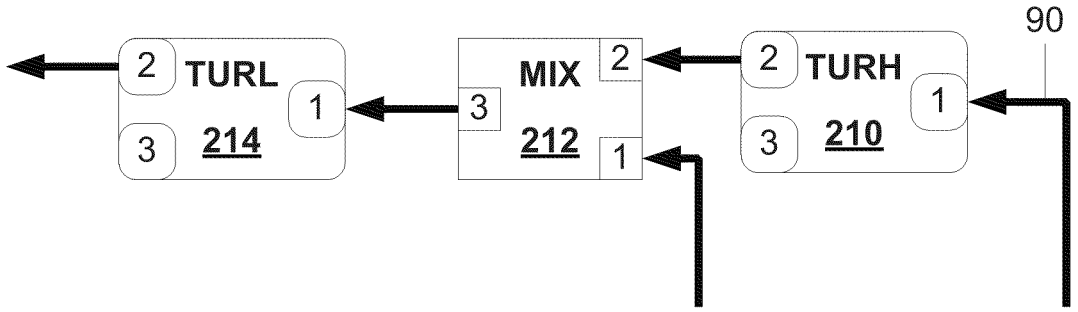
FIG. 7 illustrates a series configuration for the turbines.
Figure 8:
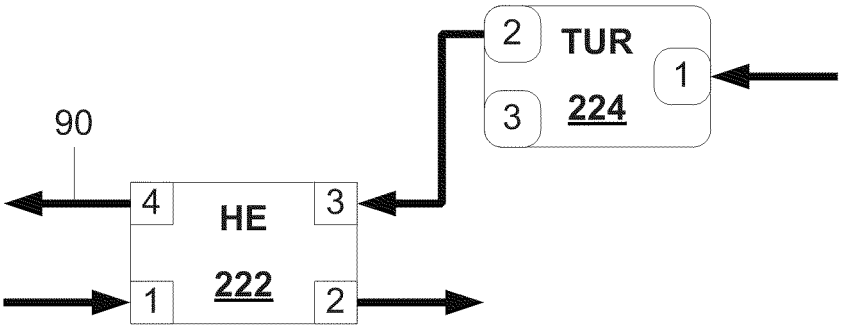
FIG. 8 illustrates a recuperation heat exchanger.

FIG. 6 through FIG. 8 show reconfigurations of certain circuit elements which can be applied to any of the circuits previously discussed.

Figure 10:
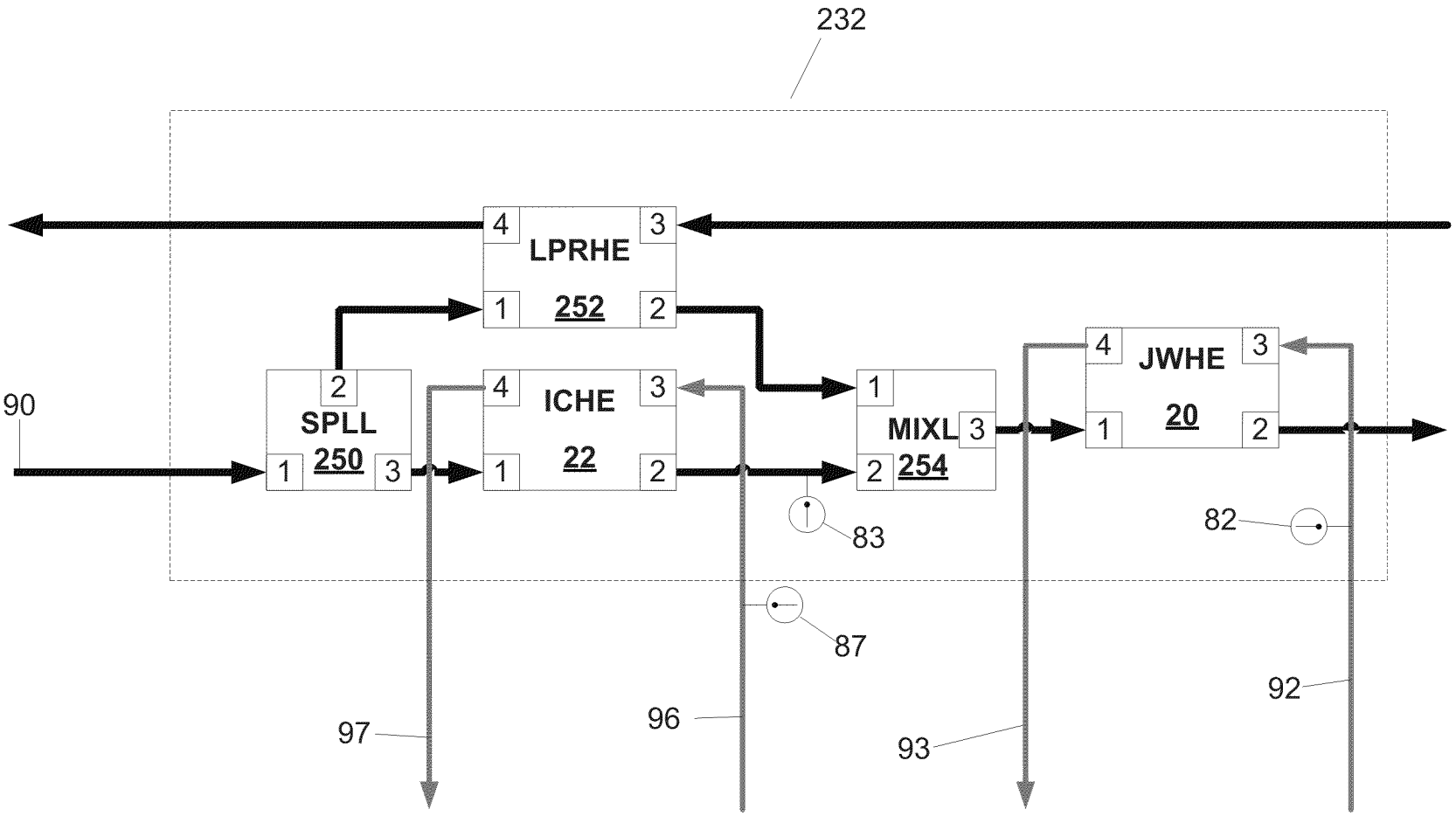
FIG. 10 illustrates a more detailed schematic of the grouping of heat exchangers for the first pressure circuit of the schematic shown in FIG. 13.

FIG. 6 shows a reconfiguration of the media pumps. In the previous figures, the media pumps were arranged in parallel. For example, the circuit in FIG. 2 shows RM 90 flowing into SPL1 12 and from there into inlet port 1 of PMPH 14 and into inlet port 1 of PMPL 16. Alternatively, the pumps can be arranged serially as shown in FIG. 10. In this configuration, RM 90 flows into inlet port 1 of a Low Pressure Media Pump 200. RM 90 exits pump 200 at port 2 at which time it flows into a splitter 202, hereafter SPL. SPL 202 can be either passive or controlled, depending on the overall circuit configuration. Some portion of RM 90 entering SPL 202 is directed to output port 2, at which time it enters inlet port 1 of a High Pressure Media Pump 204. The remaining RM 90 is directed to the LTHP half of the circuit.

This serial configuration of the media pumps is desirable because it provides the means to maximize the pressure in the HTHP circuit. Pressure pumps with a high pressure ratio being supplied with fluids close to their boiling point can have issues with the fluid at the inlet side of the pump both boiling and cavitating. This causes accelerated wear of the pump, may physically damage the pump, and also could be detrimental to the fluid being pumped. Typical Rankine systems will have a boost or feed pump to slightly increase the fluid pressure before it is fed into the higher pressure ratio pump. This prevents cavitation at the inlet of the higher pressure ratio pump, which by its design, is more susceptible to cavitation damage. While the use of a separate feed/boost pump does reduce the likelihood that such problems will occur, its use also increases cost and complexity and reduces efficiency.

In a Rankine system running with a single condenser and multiple pressure loops, the pump that pressurizes the RM 90 in the lower temperature pressure circuit can also be used as a boost or feed pump for the HTHP circuit. Typical LTHP circuits in this type of system will run at a pressure ratio of 2-3:1. The HTHP circuit will run a higher pressure ratio approaching 10:1. With a boost pump pressure ratio of 2:1, the high pressure circuit would see fluid at its inlet far from its boiling point and will only need a pressure ratio of 5:1 to reach a total pressure ratio of 10:1.

Figure 9:
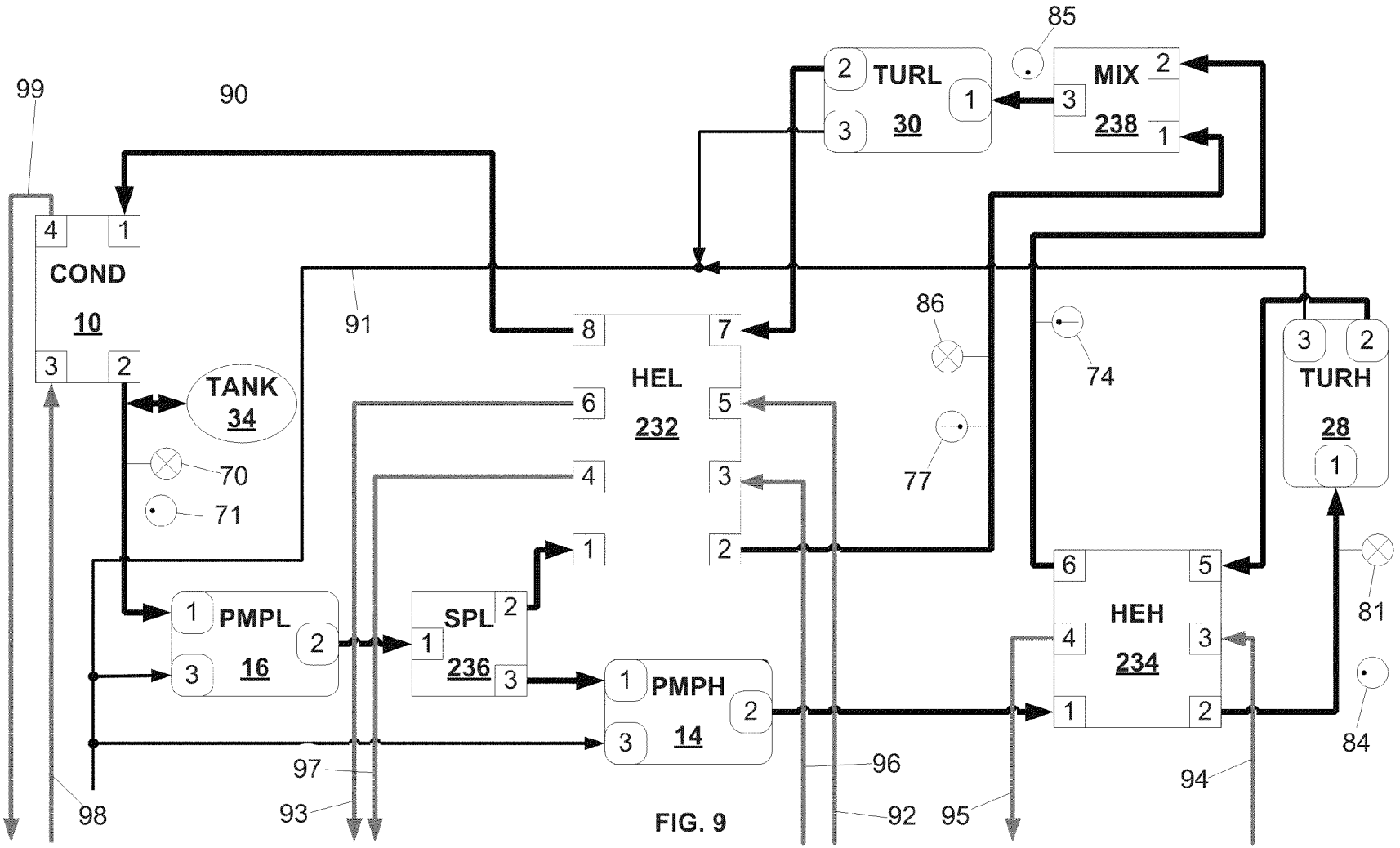
FIG. 9 illustrates in schematic a system using a single condenser with two pressure circuits, wherein the pumps and turbines are in series and heat exchangers with recuperation circuits are employed.

Using the LTHP circuit pump as a boost/feed pump for the HTHP circuit pump has another advantage. In a circuit in which the HTHP circuit is plumbed with the superheated vapors exiting the TURH 28 being mixed with the superheated vapors of the LTHP circuit before the inlet of the LTHP circuit turbine, as illustrated in FIG. 9, control of the LTHP is simplified by matching the flow rate through both the LTHP pump and turbine. If this were not the case, then the turbine would see the combined independent flow from two independent pumps and would have to dynamically respond to changes in both flow rates as the LTHP circuit turbine tries to maintain a stable turbine inlet pressure.

Figure 11:
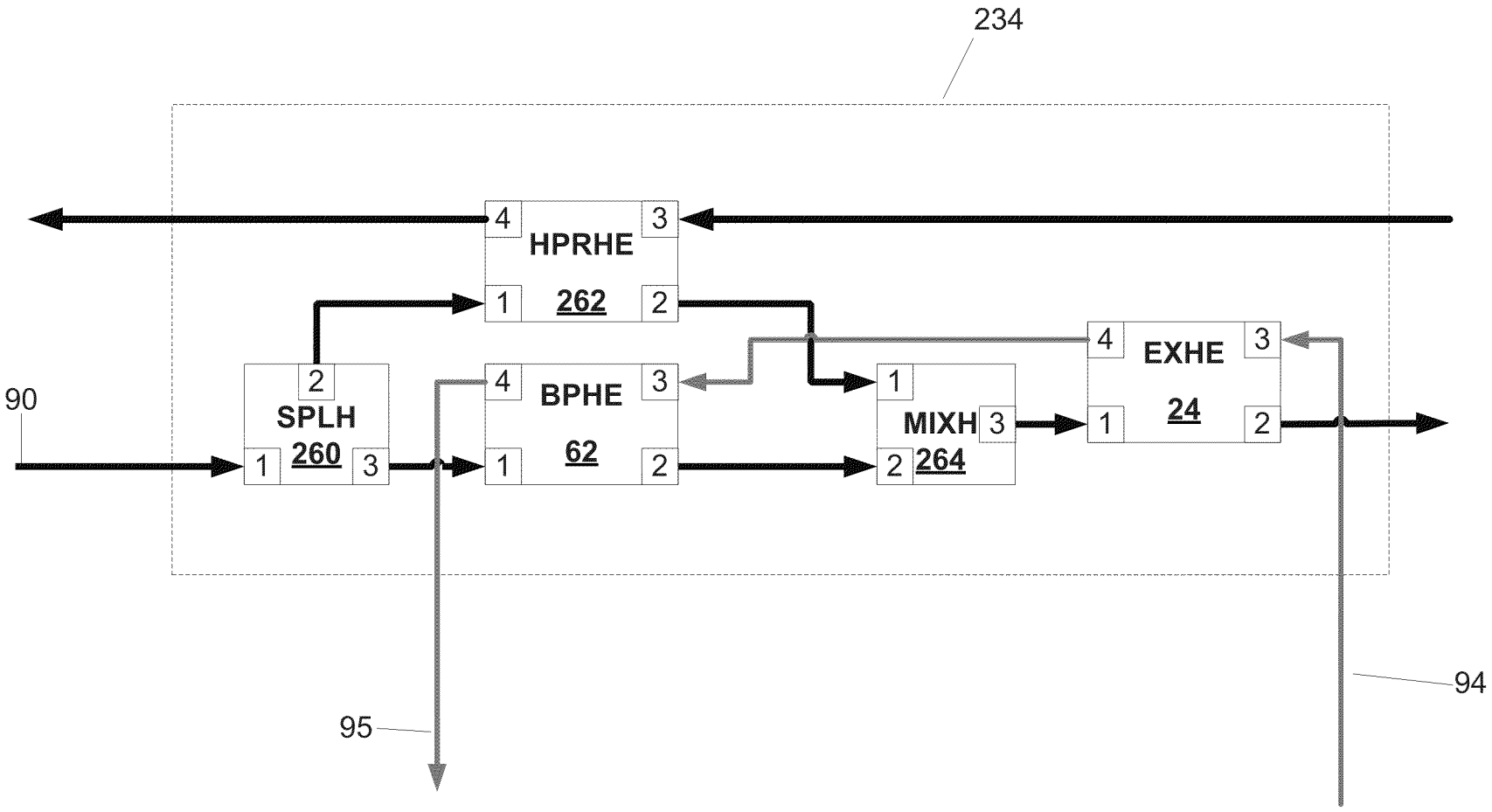
FIG. 11 illustrates a more detailed schematic of the grouping of heat exchangers for the second pressure circuit of the schematic shown in FIG. 13.

FIG. 7 shows a reconfiguration of the turbines. In the previous figures, said turbines were arranged in parallel. For example, the circuit in FIG. 2 shows independent streams of RM 90; one flowing into inlet port 1 of TURH 28 and the second into inlet port 1 of TURL 30, with the output from both turbines being combined by MIX4 32 before going to the inlet port 1 of COND 10. Alternatively, the turbines can be arranged serially as shown in FIG. 11. In this configuration, superheated RM 90 from the HTHP circuit flows into inlet port 1 of a HTHP turbine 210. The partially expanded RM 90 discharged from TURH 28 at port 2 then flows into inlet port 2 of a mixer 212, which can be either passive or controlled, depending on the overall circuit configuration. Superheated RM 90 from the LTHP circuit enters mixer 212 at inlet port 1, and the outlet port of mixer 212 is connected to inlet port 1 of a LTHP turbine 214.

A serial configuration of the turbines is desirable because a radial inflow turbine is typically limited to an 8:1 pressure ratio. The use of radial inflow turbines in this application is desirable because they are robust, simple, low cost, high efficiency, and easily designed and manufactured with variable inlet geometry. However, to maximize system thermal efficiency, an overall pressure ratio of greater than 8:1 is desired. By running in series, we have a first pressure ratio, e.g., 3:1, followed by a second pressure ratio, e.g., 6:1, which results in an overall pressure ratio which is the product of the two ratios, e.g., 18:1.

FIG. 8 shows the application of a recuperation circuit. In this circuit, RM 90 exiting a turbine 224 does not flow directly back to COND 10, as previously illustrated, but instead first flows through a heat exchanger 222 functioning as a recuperator. This configuration is desirable in a Rankine cycle because a recuperator can transfer some of the heat energy left over in the expanded but still superheated vapors exiting the turbine to the pressurized liquid RM which has exited the pressure pump. By recovering some of the energy usually expelled at the condenser as waste heat, the recuperator can make a rankine cycle significantly more efficient.

FIG. 9 shows a schematic of a system using a single condenser with two pressure circuits which employ the improvements described in FIGS. 6-8. Rankine media 90 circulates throughout the system, which is a closed-loop system. The description of the cycle arbitrarily starts with a heat exchanger 10.

The heat exchanger 10, hereafter Ambient Fluid Cooled Condenser (COND), takes in cool cooling media 98, typically ambient air, at inlet port 3 and after absorbing heat from the working fluid flowing through the opposite chamber of the heat exchanger, heated cooling media 99 exits COND 10 at outlet port 4, typically via discharge to the atmosphere. COND 10 inlet port 1 takes in superheated or mixed liquid/vapor RM 90. As RM 90 flows through COND 10, sufficient heat is extracted to cool it to a low enough temperature that it condenses to a liquid phase. Cooled, liquid RM 90 exits COND 10 at outlet port 2, from which it flows to inlet port 1 of a pump 16, hereafter Low Pressure Media Pump (PMPL).

At some location between outlet port 2 of COND 10 and inlet port 1 of PMPL 16, is a connection to a tank 34, hereafter TANK.

Pressure sensor 70 measures the pressure of RM 90 as it exits COND 10 and is hereafter referred to as P_cond. Temperature sensor 71 measures the temperature of RM 90 as it exits COND 10 and is hereafter referred to as T_cond.

Using electrical power taken from DC Bus 91, which enters PMPL 16 via inlet port 3, PMPL 16 pressurizes RM 90 to a working pressure and directs it to outlet port 2, from which it flows to inlet port 1 of a of a splitter 236, hereafter Splitter (SPL).

SPL 236 is a passive device. Based on demand from a pump 14, a portion of RM 90 is directed to outlet port 2, from which it flows to a group of heat exchangers 232, collectively referred to as Heat Exchanger LTHP (HEL). Remaining RM 90 is directed to outlet port 3, from which it flows to inlet port 1 of a pump 14, hereafter High Pressure Media Pump (PMPH).

HEL 232 takes in cooled, pressurized RM 90 at inlet port 1 and after absorbing heat from heated jacket water 92, heated charge air 96, and a recuperator, heated pressurized RM 90 exits HEL 232 at outlet port 2, from which it flows to inlet port 1 of a mixer 238, hereafter Mixer (MIX). The operation of HEL 232 is described in FIG. 10.

Pressure sensor 86 measures the pressure of RM 90 in the LTHP circuit and is hereafter referred to as P_lthp. Temperature sensor 77 measures the temperature of RM 90 as it exits HEL 232 and is hereafter referred to as T_lthp.

Using electrical power taken from DC Bus 91, which enters PMPH 14 via inlet port 3, PMPH 14 pressurizes RM 90 to a working pressure and directs it to outlet port 2, from which it flows to a groups of heat exchangers 234, collectively referred to as Heat Exchanger HTHP (HEH).

HEH 234 takes in cooled, pressurized RM 90 at inlet port 1 and after absorbing heat from the exhaust gas 94 and a recuperator, heated pressurized RM 90 exits HEH 234 at outlet port 2, from which it flows to inlet port 1 of a turbine 28, hereafter High Pressure Turbine (TURH). The operation of HEH 234 is described in FIG. 11.

Pressure sensor 81 measures the pressure of RM 90 in the HTHP circuit and is hereafter referred to as P_hthp. Temperature sensor 84 measures the temperature of RM 90 as it enters TURH 28 and is hereafter referred to as T_turh.

Superheated RM 90 is expanded in TURH 28 which converts a portion of the thermodynamic energy contained within the working fluid to electrical energy, which is provided to DC Bus 91 via outlet port 3. RM 90, now at a lower pressure and temperature, exits TURH 28 at outlet port 2 from which it flows to inlet port 5 of HEH 234. The fluid exits HEH 234 via outlet port 6 from which it flows to inlet port 2 of a MIX 238.

MIX 238 combines the two streams of working fluid from inlet ports 1 and 2 and sends combined stream to inlet port 1 of a turbine 30, hereafter Low Pressure Turbine (TURL).

Temperature sensor 74 measures the temperature of RM 90 as it exits the HEH 234 and is hereafter referred to as T_recup. Temperature sensor 85 measures the temperature of RM 90 as it enters TURL 30 and is hereafter referred to as T_turl. Note that with knowledge of the fraction of the RM 90 flowing in either (or both) of the LTHP or HTHP circuits, only two of temperature sensors 74, 77, or 85 are needed as the temperature of the third can be calculated from the other two.

Superheated RM 90 is expanded in TURL 30 which converts a portion of the thermodynamic energy contained within the working fluid to electrical energy, which is provided to DC Bus 91 via outlet port 3. RM 90, now at a lower pressure and temperature, exits TURL 30 at outlet port 2 from which it flows to inlet port 7 of MHEL 232. The fluid exits MHEL 232 via outlet port 8 from which it flows to inlet port 1 of COND 10, thus completing the closed loop of the Rankine cycle.

The closed loop system described creates net electrical power, that is, the sum of the power generated by TURH 28 and TURL 30 is greater than the sum of the power consumed by PMPH 14 PMPL 16, and other necessary devices, such as a control system, valves, etc. DC Bus 91 is electrically connected to the electrical bus of the system into which the waste heat recovery system described herein is mounted, thus, the power generated is available for system use.

FIG. 10 shows a schematic of the group of heat exchangers 232, collectively referred to as Heat Exchanger LTHP (HEL). Cooled, pressurized RM 90 flows to inlet port 1 of a splitter 250, hereafter SPLL. SPLL 250 is controlled device. Based on a signal from the control system, a portion of RM 90 is directed to outlet port 2, from which it flows to inlet port 1 of a heat exchanger 252, hereafter Low Pressure Recuperator Heat Exchanger (LPRHE). Remaining RM 90 is directed to outlet port 3, from which it flows to inlet port 1 of a heat exchanger 22, hereafter Intercooler Heat Exchanger (ICHE).

LPRHE 252 takes in cooled, pressurized RM 90 at inlet port 1 and after absorbing heat from the hot, expanded RM 90 flowing through the opposite chamber of the heat exchanger, heated pressurized RM 90 exits LPRHE 252 at outlet port 2, from which it flows to inlet port 1 of a mixer 254, hereafter Mixer L (MIXL). LPRHE 252 inlet port 3 takes in hot, expanded RM 90 which has just exited TURL 30. Heat is extracted from this fluid after which it exits LPRHE 252 at outlet port 4, and is then sent to inlet port 1 of COND 10, thus completing the closed loop of the Rankine cycle, see FIG. 9.

ICHE 22 takes in cooled, pressurized RM 90 at inlet port 1 and after absorbing heat from the charge air flowing through the opposite chamber of the heat exchanger, heated pressurized RM 90 exits ICHE 22 at outlet port 2, from which it flows to inlet port 2 of MIXL 254. ICHE 22 inlet port 3 takes in heated charge air 96. As charge air flows through ICHE 22, heat is extracted from this fluid to increase the temperature of the RM 90. Cooled charge air 97 exits ICHE 22 at outlet port 4, from which it is returned to the engine.

Temperature sensor 83 measures the temperature of RM 90 as it exits ICHE 22 and is hereafter referred to as T_iche. Temperature sensor 87 measures the temperature of heated charge air 96 as it enters ICHE 24 and is hereafter referred to as T_charge.

MIXL 254 combines the two streams of RM 90 from inlet ports 1 and 2 and sends combined stream to inlet port 1 of a heat exchanger 20, hereafter Jacket Water Heat Exchanger (JWHE).

As described, SPLL 250 is a controlled device and MIXL 254 is a passive device. A completely equivalent embodiment replaces SPLL 250 with a passive splitter and MIXL 254 with an controlled mixer.

JWHE 20 takes in warmed, pressurized RM 90 at inlet port 1 and after absorbing heat energy from the jacket water cooling fluid flowing through the opposite chamber of the heat exchanger, heated pressurized RM 90 exits JWHE 20 at outlet port 2, from which it flows to inlet port 1 of a turbine 30, hereafter Low Pressure Turbine (TURL). JWHE 20 inlet port 3 takes in heated jacket water cooling fluid 92. As jacket water cooling fluid flows through JWHE 20, sufficient heat is extracted to cause RM 90 to become superheated vapor. Cooled jacket water cooling fluid 93 exits JWHE 20 at outlet port 4, from which it is returned to the engine in a closed-loop manner.

Temperature sensor 82 measures the temperature of heated jacket water cooling fluid 92 as it enters JWHE 20 and is hereafter referred to as T_eng.

FIG. 11 shows a schematic of the group of heat exchangers 234, collectively referred to as Heat Exchanger HTHP (HEH). Cooled, pressurized RM 90 flows to inlet port 1 of a splitter 260, hereafter SPLH. SPLH 260 is controlled device. Based on a signal from the control system, a portion of RM 90 is directed to outlet port 2, from which it flows to inlet port 1 of a heat exchanger 262, hereafter High Pressure Recuperator Heat Exchanger (HPRHE). Remaining RM 90 is directed to outlet port 3, from which it flows to inlet port 1 of a heat exchanger 62, hereafter Bypass Exhaust Heat Exchanger (BPHE).

HPRHE 262 takes in cool, pressurized RM 90 at inlet port 1 and after absorbing heat from the hot, expanded RM 90 flowing through the opposite chamber of the heat exchanger, heated pressurized RM 90 exits HPRHE 262 at outlet port 2, from which it flows to inlet port 1 of a mixer 264, hereafter Mixer H (MIXH). LPRHE 252 inlet port 3 takes in hot, expanded RM 90 which has just exited TURH 28. Heat is extracted from this fluid to increase the temperature of the RM 90, which then exits HPRHE 262 at outlet port 4, and is then sent to inlet port 2 of MIX 238, see FIG. 9.

BPHE 62 takes in cooled, pressurized RM 90 at inlet port 1 and after absorbing heat from the partially cooled exhaust gas flowing through the opposite chamber of the heat exchanger, heated pressurized RM 90 exits BPHE 62 at outlet port 2, from which it flows to inlet port 2 of MIXH 264. BPHE 62 inlet port 3 takes in partially cooled exhaust gas. As exhaust gas flows through BPHE 62, heat is extracted from this fluid to increase the temperature of the RM 90. Cooled exhaust gas 95 exits BPHE 62 at outlet port 4, from which it is typically discharged to the atmosphere.

MIXH 264 combines the two streams of RM 90 from inlet ports 1 and 2 and sends combined stream to inlet port 1 of a heat exchanger 24, hereafter Exhaust Heat Exchanger (EXHE).

As described, SPLH 260 is a controlled device and MIXH 264 is a passive device. A completely equivalent embodiment replaces SPLH 260 with a passive splitter and MIXH 264 with a controlled mixer.

EXHE 24 takes in preheated pressurized RM 90 at inlet port 1 and after absorbing heat from the exhaust gas flowing through the opposite chamber of the heat exchanger, heated pressurized RM 90 exits EXHE 24 at outlet port 2, from which it flows to inlet port 1 of a turbine 28, hereafter High Pressure Turbine (TURH). EXHE 24 inlet port 3 takes in heated, typically clean, exhaust gas 94. As exhaust gas flows through EXHE 24, sufficient heat is extracted to cause RM 90 to become superheated vapor. Cooled exhaust gas 94 exits EXHE 24 at outlet port 4, from which it flows to inlet port 3 of BPHE 62.

FIG. 2 illustrates the simplest version of the WHRS with both a LPHT and HTHP circuit sharing a common low pressure condensing circuit. This system is superior to prior art systems in that it harnesses not only the exhaust waste heat, but also the entire amount of waste heat in the jacket water system. Multiple benefits of this system include a higher amount of excess work created from the waste heat of the system, typically an addition 33% of fuel use reduction over a system that only captures exhaust system heat. Simplification of the cooling system, by capturing all of the jacket water heat energy the engine can now have a single heat exchanger, COND 10, that interfaces with the environment to reject the unused heat energy. If the COND 10 can be made as a single pass unit, it could take the incoming external cooling fluid from either direction which could be important in a device such as a locomotive that may travel in either direction through the air.

FIG. 3 expands on the circuit of figure two by adding the waste heat from the pressurized charge air to the HTHP circuit. The advantage to capturing the ICHE 22 energy in the HTHP circuit is that this circuit will run at a higher thermal efficiency than the LTHP circuit. Depending on the expander design, the HTHP circuit may have twice the thermal efficiency as the LTHP circuit. This would be the preferred system when the engine is highly boosted and runs consistently at high power level. In this case the temperature of the charge air entering the WHRS will typically be above 220 C and will add to the amount of energy that the HTHP circuit can recover at its higher thermal efficiency.

FIG. 4 is very similar to FIG. 3 except that the ICHE 22 energy is captured in the LTHP circuit instead of the HTHP circuit. This provides additional benefit as compared to FIG. 3 when the engine boost levels are lower and/or the engine is not consistently run at full power. In FIG. 3, when the engine operates at low power settings, the charge air may enter the WHRS at temperatures lower than the desired HTHP turbine inlet temperature, thus the EXHE 24 may have to raise RM 90 to an excessively high temperature to insure that the average temperature of the combined RM 90 fluids from both the ICHE 22 and EXHE 24 at the exit of the Mix 3A 26 are at the desired HTHP turbine inlet temperature. This excessively high RM 90 temperature at the EXHE 24 exit can cause permanent damage to the RM 90 and should be avoided. When the ICHE 22 is incorporated into the LTHP circuit, both the JWHE 20 and the ICHE 22 waste heat media temperatures are lower than 200 C which is safe for R245fa as a working fluid, but will still be above the boiling temperature at this pressure of approximately 85 C. This will eliminate potential to damage the RM 90 present in FIG. 3's circuit with heat from these waste heat streams.

FIG. 5 is a circuit that combines the higher system efficiency of capturing the ICHE 22 heat in the HTHP circuit as in FIG. 3, without the previously discussed risk of the EXHE 24 having to overheat the RM 90 to reach the desired inlet temperature of TURH 28. In this case the ICHE 22 is in series with EXHE 24 and serves to preheat the RM 90 before it reaches the EXHE 24. Once the RM 90 leaves the ICHE 22, the EXHE 24 will continue increasing the temperature of the RM 90 until it is at the desired inlet temperature of the TURH 28. This circuit has a Bypass Heat Exchanger, BPHE 62, in parallel with the ICHE 22. It is utilized to capture more of the heat energy from the engine exhaust waste heat media stream. Because incoming RM 90 to the EXHE 24 is preheated, RM 90 will leave the ICHE 22 at a temperature higher than the temperature the RM 90 left the PMPH 14, the exhaust gasses will now exit the EXHE 24 at a higher temperature. This higher temperature exhaust gas stream still contains a portion of the waste heat that would have been captured if the RM 90 entering EXHE 24 was still at the exit temperature of PMPH 14. The BPHE 62 captures a portion of this left over waste heat energy in the exhaust gas waste heat stream that could not be captured when the exhaust gasses first passed through the EXHE 24. By using the BPHE 62 in parallel with the ICHE 22, this system extracts as much energy as possible in the HTHP circuit maximizing the amount of energy the HTHP circuit system can generate from these three waste heat streams.

FIGS. 9, 10 and 11 detail a system which uses series pumps, series turbines, and recuperation to further increase the thermal efficiency of the WHRS system. In the case that a dry type of RM 90 is used such as the refrigerant R245fa, the peak thermal efficiency of non-recuperated Rankine cycle is actually achieved when the RM 90 enters the expander at a temperature just slightly above its boiling temperature. There is no thermal efficiency advantage to superheating a dry type RM 90. Maintaining an exit temperature close to the boiling temperature would necessitate very precise sensing of temperature and pressure and would drastically increase the difficulty of controlling this system especially in dynamic or transient conditions. Running the cycle slightly superheated with the turbine inlet temperature higher than the boiling point reduces the difficulty of controlling the system. Using recuperating heat exchangers as in FIG. 9 has two benefits. It increases the thermal efficiency by recapturing some of the heat energy that would have been rejected by COND 10 to the atmosphere. It also allows the flexibility of operating the system at superheated temperatures without significantly decreasing the thermal efficiency that would be caused by leaving excess energy in the turbine exhaust flow due to the superheating and then discharging it at COND 10.

The schematic shown in FIG. 10 is particularly beneficial as the LTHP circuit captures the heat from three different fluid streams, the jacket water, pressurized charge air, and a recuperator, which requires three independent heat exchangers. For an embodiment in which RM 90 comprises R245fa, the heat absorbed in the LTHP circuit may preferentially be carried out in two stages.

At the RM 90 inlet to the HEL 232 group of heat exchangers, the cooled, approximately 40 C, pressurized RM 90 is run in parallel through parallel heat exchangers ICHE 22 and the Low Pressure Recuperator Heat Exchanger, LPRHE 252, which comprise the first stage. In the ICHE, a significant portion of the waste heat energy in the pressurized charge air is absorbed. In LPRHE, heat energy from the RM 90 that previously exited the TURL 30 is recuperated.

The goal of the first stage is to preheat the RM 90 to its boiling temperature and start adding the latent heat of vaporization energy needed to boil the fluid. This eliminates the need for the JWHE 20, which comprises the second stage, to expend some of the recoverable waste heat energy to raise the temperature of the RM 90 from the COND 10 exit temperature to its boiling temperature. The JWHE 20 is now able to use all of its recovered heat energy to boil the RM 90 creating slightly superheated vapor. Preheating the RM 90 to boiling temperature requires 33% of the energy required to vaporize it, thus if preheating successfully gets the RM 90 to its boiling temperature, the mass flow of RM 90 can be increased by 33% which increases the work output of the expander by 33%. Another benefit of the recuperating section of the first stage is that it further cools the expanded RM 90 flowing into the condenser, which could simplify the design and manufacture of the condenser from a multipass unit to a single pass unit. In addition to cost and design, a further benefit of a single pass unit is the ability to use it bidirectionally as a multipass unit would only be able to effectively harness cooling air in one direction. If the return temperature were significantly higher, there would be the need for a separate RM 90 pass in the condenser to insure the cooling media that removed this heat had already been used to extract the latent heat of vaporization in a previous RM 90 pass, otherwise the overall volume of the condenser would have to be increased to accommodate the increased airflow and heat transfer area needed.

After preheating in the first two heat exchangers, the RM 90 flows into the JWHE 20 where it is converted into a slightly superheated vapor. It may already be preheated to its boiling temperature, but will absorb all of the waste heat energy in the engine jacket water coolant in order to vaporize and slightly superheat the RM 90. In one embodiment, the energy required to convert the RM 90 from a liquid to a gas at 90C, its latent heat of vaporization, is approximately 93 time larger than the amount of energy required to increase the liquid temperature 1 degree C., the fluid's specific heat. For the vaporized RM the ratio of latent heat to specific heat is approximately 113.

Similar to previous figures, parallel heat exchangers running in the same high pressure circuit will need mixers and splitters. These can provide distribution of the flow by having a pressure drop difference between the two parallel flow paths. One method is passive where the circuits are designed to have an appropriate pressure drop difference to split the flow as desired. Another method is to have a controlled splitter before the ICHE 22 and the LPRHE 252, or a controlled mixer after, this would actively control the ratio of RM 90 to each device. The setting for the controlled mixer of splitter would be calculated by measuring the exit temperature of both the pressurized charge air and the low pressure RM 90 on its way to the COND 10. The fluid stream with the higher exit temperature would be allocated a higher percentage of the RM 90 flow. Once the different portions of RM 90 have flowed through the ICHE 22 and LPRHE 252, they will be mixed into one fluid stream for its passage through the JWHE 20.

FIG. 11 Illustrates a parallel and series set of heat exchanger similar to FIG. 10 except that these heat exchangers are in the HTHP circuit. The two parallel heat exchangers are the High Pressure Recuperating Heat Exchanger, HPRHE 262 and the Bypass Exhaust Heat Exchanger, BPHE 62. These are in series with the EXHE 24. There is a unique situation in these high pressure Rankine cycles used in mobile application WHRS due to their smaller size than stationary facility based systems. With R245fa as a refrigerant, typical HTHP circuit operating conditions will have a similar mass flow rate for the RM 90 as the ICE has for its exhaust gasses. A significant difference between the two fluids at their respective turbine inlets will be the density difference, with the RM 90 being 150 to 200 times more dense and having a volume flow rate inversely proportional. If an attempt is made to use a turbine as the expander, it would have a turbine rotor with approximately 1/100th of the flow area of the ICE turbocharger turbine to handle this very small volume flow rate, with current technology this size turbine is impractical for engines of 2000 HP or less. In this case it is likely that some other form of mechanical expander would be used, and due to the small size and high pressure ratio of this expander, efficiencies in the 50% range and below can be expected. This large inefficiency in the turbine will greatly increase the exit temperature and heat energy content of the expanded RM 90 leaving the expander. This potentially lost heat energy added to the amount of superheat energy already incorporated into the cycle makes the use of a recuperator that much more valuable. Because the recuperator heat exchanger preheats the RM 90 on its way to the EXHE 24, the exhaust gasses leaving the EXHE 24 will have a temperature significantly higher than the RM 90 exit temperature from the PMPH 14 and therefore a measurable amount of heat energy that is recoverable. That heat energy would be captured by the BPHE 62. If this were an ICE running methane gas, there would also be a significant amount of energy recoverable by condensing the water out of the exhaust gasses which would be done at the lower temperatures seen in the operating conditions of the BPHE 62.

FIGS. 13-19 illustrate a control scheme for the waste heat recovery systems shown in FIGS. 2-11.

Control of these waste heat recovery systems is accomplished by controlling between five and seven devices. FIG. 12 provides a summary table indicating which control schemes apply to each schematic. The control schemes and schematics represent one approach for controlling the system disclosed and are exemplary in nature. It will be apparent to one of ordinary skill in the art that other, functionally equivalent control schemes and schematics can be applied to system disclosed which will yield the same operational characteristics.

Figure 13:
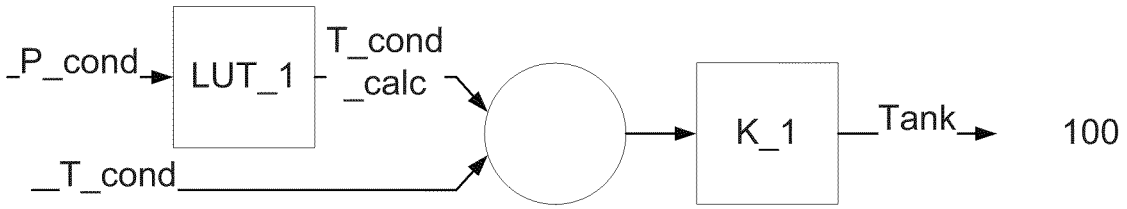
FIG. 13 illustrates the control scheme for controlling the TANK.

FIG. 13 provides a control scheme 100 for the control of the TANK 34, which is accomplished by controlling pressure P_cond. Control scheme 100 applies to the schematics shown in FIGS. 2-5 and 9.

Pressure P_cond controls the temperature at which the RM 90 condenses. At higher ambient temperatures, the pressure needs to be higher to allow RM 90 to condense at a higher temperature. The relationship between ambient temperature and required pressure is stored in lookup table LUT_1, which is determined by the design of COND 10.

Pressure P_cond is controlled in a closed-loop in the following manner. P_cond is applied to LUT_1 to determine the temperature at which RM 90 is a completely condensed liquid, hereafter T_cond_calc. This temperature reading is compared to temperature T_cond. If T_cond is greater than T_cond_calc, then the system pressure needs to be increased. If T_cond is less than T_cond_calc, then the system pressure needs to be decreased. To affect a change in system pressure, the difference between T_cond_calc and T_cond is calculated and the difference is then subjected to control block K_1, whose output causes TANK 34 to either remove or inject RM 90 into the circuit, thereby controlling pressure P_cond.

Figure 14:
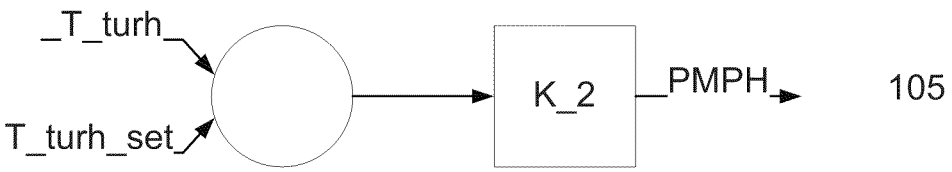
FIG. 14 illustrates the control scheme for controlling the PMPH.

FIG. 14 provides control scheme 105 for the control of the PMPH 14 which is accomplished by controlling temperature T_turh. Control scheme 105 applies to the schematics shown in FIGS. 2-5 and 9.

To maximize the energy extracted by TURH 28, the temperature of RM 90 at inlet 1 should be as high as needed with respect to the available heat energy and pressure drop across the expander, without exceeding the temperature at which RM 90 is damaged. Since the temperature of the exhaust stream is typically quite high, approximately 600 C, damage to RM 90 can potentially occur. A set point value defines the desired turbine inlet temperature, hereafter T_turh_set.

Referring to control scheme 105, temperature T_turh is controlled in a closed-loop in the following manner. If T_turh_set is greater than T_turh, then the flow rate of RM 90 through the HTHP circuit can be decreased. If T_turh_set is less than T_turh, then said flow rate should be increased. To affect a change in flow rate, the difference between T_turh_set and T_turh is calculated and the difference is then subjected to control block K_2, whose output causes PMPH 14 to either increase or decrease the amount of RM 90 pumped, thereby controlling T_turh.

Figure 15:
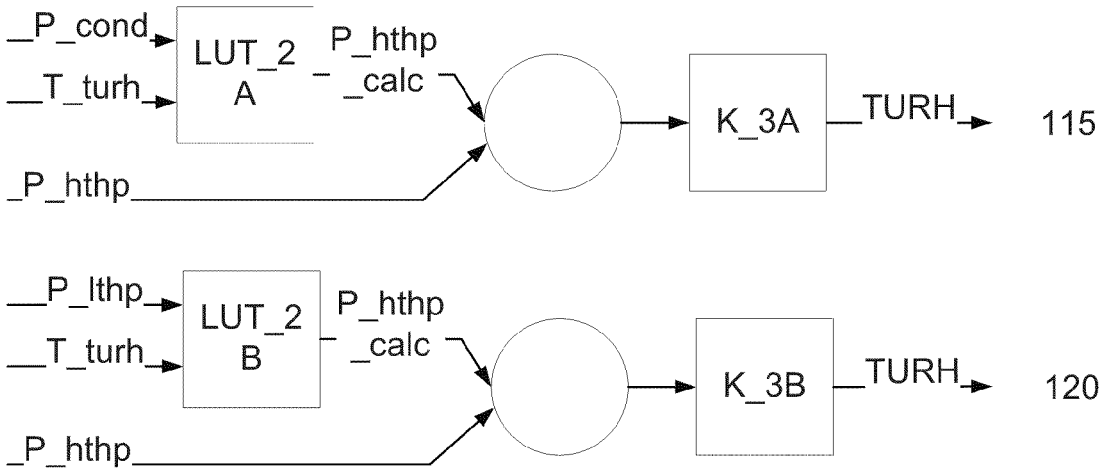
FIG. 15 illustrates the control scheme for controlling the TURH.

FIG. 15 provides control schemes 115 and 120 for the control of the TURH 28, which is accomplished by controlling pressure P_hthp. Control scheme 115 applies to the schematics shown in FIGS. 2-5; and control scheme 120 applies to the schematic shown in FIG. 9.

To maximize the energy extracted by turbine TURH 28, the difference in pressure between inlet 1 and outlet 2 should be as high as possible. Typically, to prevent damage to TURH 28, no liquid should enter TURH 28. The pressure of RM 90 in the HTHP circuit determines the temperature at which RM 90 boils. Thus, it is desirable to superheat the vapor so that useful work can be extracted. This requires setting the boiling point, which is a direct function of the pressure of the fluid, appropriately to allow the vapor to become super-heated while traversing the heat exchanger. LUT_3A and LUT_3B are developed based on the design of TURH 28.

Referring to control scheme 115, pressure P_hthp is controlled in a closed-loop in the following manner. T_turh, and P_cond are applied to LUT_3A to determine the desired pressure in the HTHP circuit, hereafter P_hthp_calc. If P_hthp is less than P_hthp_calc system pressure needs to be decreased. If P_hthp is greater than P_hthp_calc system pressure needs to be increased. To affect a change in pressure, the difference between P_hthp_calc and P_hthp is calculated and the difference is then subjected to control block K_3A whose output causes the inlet geometry of TURH 28 to either increase or decrease resistance, thereby controlling pressure P_hthp.

Referring to control scheme 120, pressure P_hthp is controlled in a closed-loop in the following manner. T_turh, and P_lthp are applied to LUT_3B to determine the desired pressure in the HTHP circuit, hereafter P_hthp_calc. If P_hthp is less than P_hthp_calc system pressure needs to be decreased.

If P_hthp is greater than P_hthp_calc system pressure needs to be increased. To affect a change in pressure, the difference between P_hthp_calc and P_hthp is calculated and the difference is then subjected to control block K_3B whose output causes the inlet geometry of TURH 28 to either increase or decrease resistance, thereby controlling pressure P_hthp.

For control schemes 115 and 120, to prevent possible damage to TURH 28, if T_turh is less than a set point value, an optional bypass valve of TURH 28 is activated.

Figure 16:
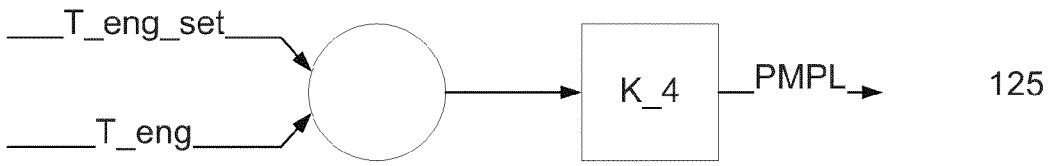
FIG. 16 illustrates the control scheme for controlling the PMPL.

FIG. 16 provides a control scheme 125 for the control of the PMPL 16, which is accomplished by controlling temperature T_eng. Control scheme 125 applies to the schematics shown in FIGS. 2-5 and 9.

It is desirable to extract sufficient heat energy from heated jacket water cooling fluid 92 since if insufficient energy is removed, the ICE could overheat and be damaged. Knowing the desired operating temperature of the engine cooling fluid, hereafter a set point value T_eng_set, and the amount of energy which needs to be removed, provides the ability to design JWHE 20. The amount of heat energy removed by JWHE 20 is determined by the mass flow rate of RM 90 through JWHE 20. Since the temperature of the waste heat stream is typically quite low, approximately 100 C, damage to RM 90 is highly unlikely in this circuit.

Temperature T_eng is controlled in a closed-loop in the following manner. If T_eng is greater than T_eng_set, then the flow rate of RM 90 through JWHE 20 should be increased. If T_eng is less than T_eng_set, then the flow rate can be decreased. To affect a change in flow rate, the difference between T_eng_set and T_eng is calculated and the difference is then subjected to control block K_4, whose output causes PMPL 16 to either increase or decrease the amount of RM 90 pumped, thereby controlling T_eng.

Figure 17:
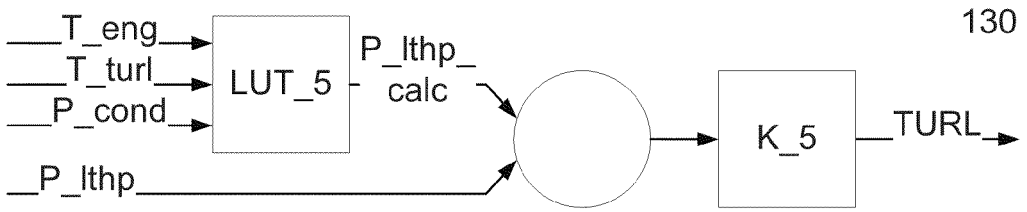
FIG. 17 illustrates the control scheme for controlling the TURL.

FIG. 17 provides a control scheme 130 for the control of the TURL 30, which is accomplished by controlling pressure P_lthp. Control scheme 130 applies to the schematics shown in FIGS. 2-5 and 9.

To maximize the energy extracted by turbine TURL 30, the temperature of RM 90 at inlet 1 should be as high as possible and the difference in pressure between inlet 1 and outlet 2 should be as high as possible. Typically, to prevent damage to TURL 30, no liquid should enter TURL 30. The pressure of RM 90 in the LTHP circuit determines the temperature at which RM 90 boils. As with all Rankine cycle machines, the energy expelled to the atmosphere when condensing the circulating media is not available for useful work. Thus, it is desirable to completely vaporize all of the RM 90 in the circuit so that useful work can be extracted. This requires setting the boiling point, which is a direct function of the pressure of the fluid, appropriately to allow the vapor to become super-heated while traversing the heat exchanger. LUT_5 is developed based on the design of TURL 30.

T_turl, T_eng, and P_lthp are applied to LUT_5 to determine the desired inlet pressure of TURL 30, hereafter P_lthp_calc. If P_lthp is less than P_lthp_calc system pressure needs to be increased. If P_lthp is greater than P_lthp_calc system pressure needs to be decreased. To affect a change in pressure, the difference between P_lthp_calc and P_lthp is calculated and the difference is then subjected to control block K_5 which causes the inlet geometry of TURL 30 to either increase or decrease resistance, thereby controlling pressure P_lthp.

To prevent possible damage to TURL 30, if T_turl is less than a set point value, the optional bypass valve of TURL 30 is activated.

Figure 18:
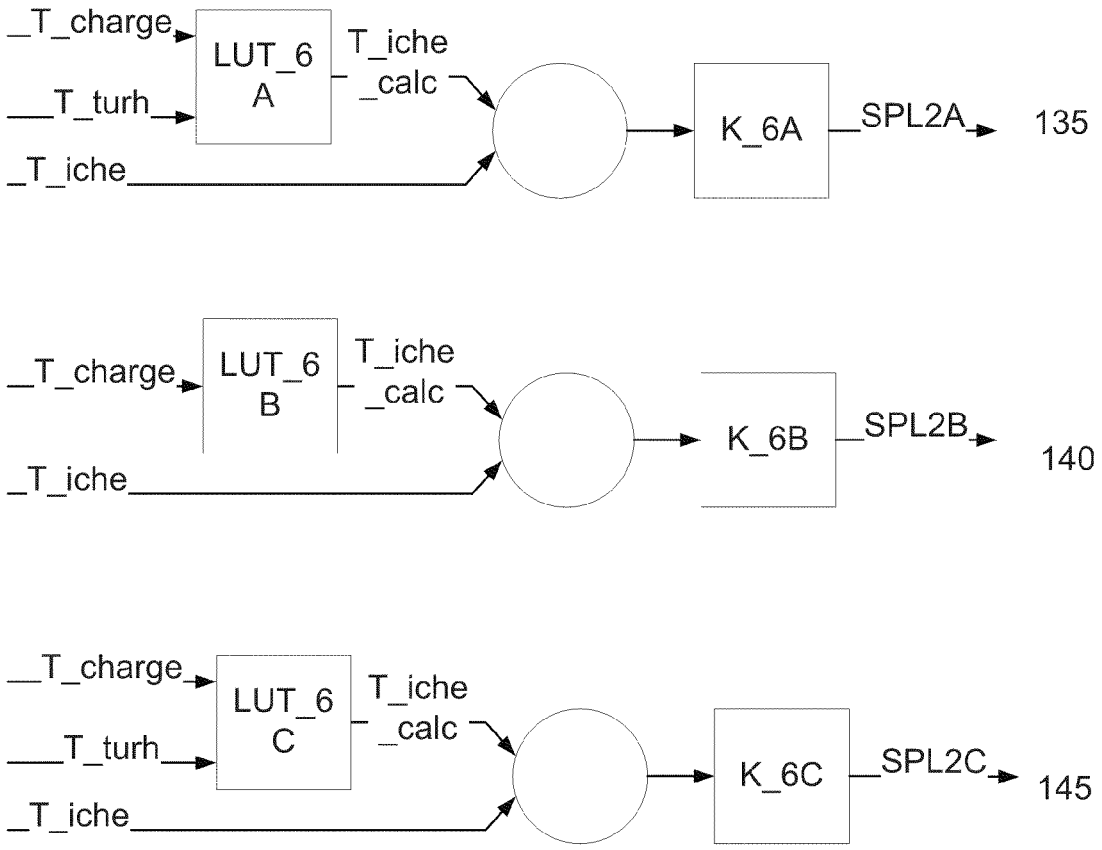
FIG. 18 illustrates the control scheme for controlling certain splitters.

FIG. 18 provides control schemes 135, 140, and 145 for the control of SPL2A 18, SPL2B 40, and SPL2C 60. Control scheme 135 applies to the schematic shown in FIG. 3. Control scheme 140 applies to the schematic shown in FIG. 4. Control scheme 145 applies to the schematic shown in FIG. 5. Control for all three schemes is accomplished by controlling temperature T_iche.

In the context of the schematics shown in FIGS. 3, 4, and 5 it is desired to extract as much heat energy as possible from heated charge air 96 to maximize efficiency. Knowing the desired operating temperature of the charge air and the amount of energy which needs to be removed provides the ability to design ICHE 22. The amount of heat energy removed by ICHE 22 is determined by the mass flow rate of RM 90 through ICHE 22.

Referring to control schemes 135, temperature T_iche is controlled in a closed loop in the following manner. T_charge and T_turl are applied to LUT_6A to determine the desired temperature that RM 90 should exit the ICHE 22, hereafter T_iche_calc. LUT_6A first calculates T_iche_calc by subtracting a specified temperature delta from the measured value T_charge. If the calculated value of T_iche_calc is more than T_turh, the value of T_turh will be assigned to T_iche_calc to prevent overheating the RM 90 fluid. The specified temperature delta is a function of the ICHE 22 design and current engine operating conditions. It sets the minimum temperature difference between the incoming waste heat stream and the exiting heated RM to allow effective heat transfer between the two media.

Once calculated, the value of T_iche_calc is compared to T_iche. If T_iche_calc is greater than T_iche, the RM 90 flow rate through ICHE 22 should be decreased. If T_turh_calc is less than T_iche, then the RM 90 flow rate should be increased. To affect a change in flow rate, the difference between T_turh_set and T_iche is calculated and the difference is then subjected to control block K_6A, which operates SPL2A 18, and thereby controlling T_iche.

Referring to control schemes 140, temperature T_iche is controlled in a closed loop in the following manner. T_charge is applied to LUT_6B to determine the desired temperature that RM 90 should exit the ICHE 22, hereafter T_iche_calc. LUT_6B calculates T_iche_calc by subtracting a specified temperature delta from the measured value T_charge. The specified temperature delta is a function of the ICHE 22 design and current engine operating conditions, it sets the minimum temperature difference between the incoming waste heat stream and the exiting heated RM to allow effective heat transfer between the two media.

Once calculated, the value of T_iche_calc is compared to T_iche. If T_iche_calc is greater than T_iche, the RM 90 flow rate through ICHE 22 should be decreased. If T_turh_calc is less than T_iche, then the RM 90 flow rate should be increased. To affect a change in flow rate, the difference between T_turh_set and T_iche is calculated and the difference is then subjected to control block K_6B, which operates SPL2*b* 40, and thereby controlling T_iche.

Referring to control schemes 145, temperature T_iche is controlled in a closed loop in the following manner. T_charge and T_turl are applied to LUT_6A to determine the desired temperature that RM 90 should exit the ICHE 22, hereafter T_iche_calc. LUT_6C first calculates T_iche_calc by subtracting a specified temperature delta from the measured value T_charge. If the calculated value of T_iche_calc is more than T_turh, the value of T_turh will be assigned to T_iche_calc to prevent overheating the RM 90 fluid. The specified temperature delta is a function of the ICHE 22 design and current engine operating conditions. It sets the minimum temperature difference between the incoming waste heat stream and the exiting heated RM to allow effective heat transfer between the two media.

Once calculated, the value of T_iche_calc is compared to T_iche. If T_iche_calc is greater than T_iche, the RM 90 flow rate through ICHE 22 should be decreased. If T_turh_calc is less than T_iche, then the RM 90 flow rate should be increased. To affect a change in flow rate, the difference between T_turh_set and T_iche is calculated and the difference is then subjected to control block K_6C, which operates SPL2C 60, and thereby controlling T_iche.

Figure 19:
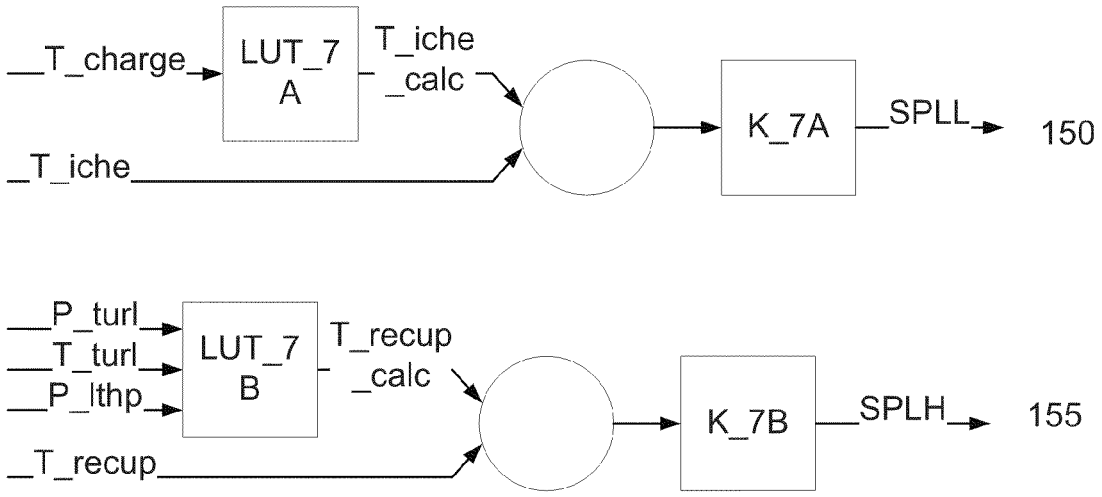
FIG. 19 illustrates the control scheme for controlling the splitters in FIGS. 10 and 11.

FIG. 19 provides control schemes 150 and 155 for the control of SPLL 250 and SPLH 260. Control scheme 150 applies to the schematic shown in FIG. 10 and control is accomplished by controlling temperature T_iche. Control scheme 155 applies to the schematic shown in FIG. 11 and control is accomplished by controlling temperature T_recup.

In the context of the schematics shown in FIG. 10 it is desired to extract as much heat energy as possible from heated charge air 96 to maximize efficiency. Knowing the desired operating temperature of the charge air and the amount of energy which needs to be removed provides the ability to design ICHE 22. The amount of heat energy removed by ICHE 22 is determined by the mass flow rate of RM 90 through ICHE 22.

Referring to control schemes 150, temperature T_iche is controlled in a closed loop in the following manner. T_charge is applied to LUT_7A to determine the desired temperature that RM 90 should exit the ICHE 22, hereafter T_iche_calc. LUT_7A calculates T_iche_calc by subtracting a specified temperature delta from the measured value T_charge. The specified temperature delta is a function of the ICHE 22 design and current engine operating conditions, it sets the minimum temperature difference between the incoming waste heat stream and the exiting heated RM to allow effective heat transfer between the two media.

Once calculated, the value of T_iche_calc is compared to T_iche. If T_iche_calc is greater than T_iche, the RM 90 flow rate through ICHE 22 should be decreased. If T_turh_calc is less than T_iche, then the RM 90 flow rate should be increased. To affect a change in flow rate, the difference between T_turh_set and T_iche is calculated and the difference is then subjected to control block K_7A, which operates SPLL 250, and thereby controlling T_iche.

In the context of the schematic shown in FIG. 11, it is desired to maximize the efficiency of the HTHP circuit by extracting a portion of the heat energy from the RM 90 leaving the TURH 28, and as much heat energy as possible from the heated exhaust gasses 94. The amount of heat energy extracted from the RM 90 exiting the TURH 28 is controlled so that as the RM 90 exits the HPRHE 262 it is at the appropriate temperature to mix with the RM 90 already in the LTHP circuit on its way into the TURL 30. Knowing the desired operating temperature of the ICE exhaust and the amount of energy which needs to be removed provides the ability to design EXHE 24. The amount of heat energy removed from the RM 90 exiting the TURH 30 by HPRHE 262 is determined by the mass flow rate of RM 90 entering the HPRHE 262 from SPLH 260.

Referring to control scheme 155, T_recup_calc is determined by LUT_7B. T_recup_calc is the desired temperature that RM 90 should exit the HPRHE 262 that is flowing into MIX 238 on its way to TURL 30. This calculated temperature is a function of T_lthp and P_lthp. During operation, if T_recup_calc is greater than T_recup, then the RM 90 flow rate through HPRHE 262 can be increased. If T_recup_calc is less than T_recup, then said flow rate should be decreased. To affect a change in flow rate, the difference between T_recup_calc and T_recup is calculated and the difference is then subjected to control block K_7B, which operates SPLH 260, and thereby controlling T_recup.

The control schemes described operate within the context of a control machine. The control machine may be a hardware programmable device (for example, relay logic), firmware programmable (for example, an embedded micro controller, ASIC, or FPGA), or software programmable (for example, a computer). The control machine comprises both memory and logic circuits.

Figure 20:
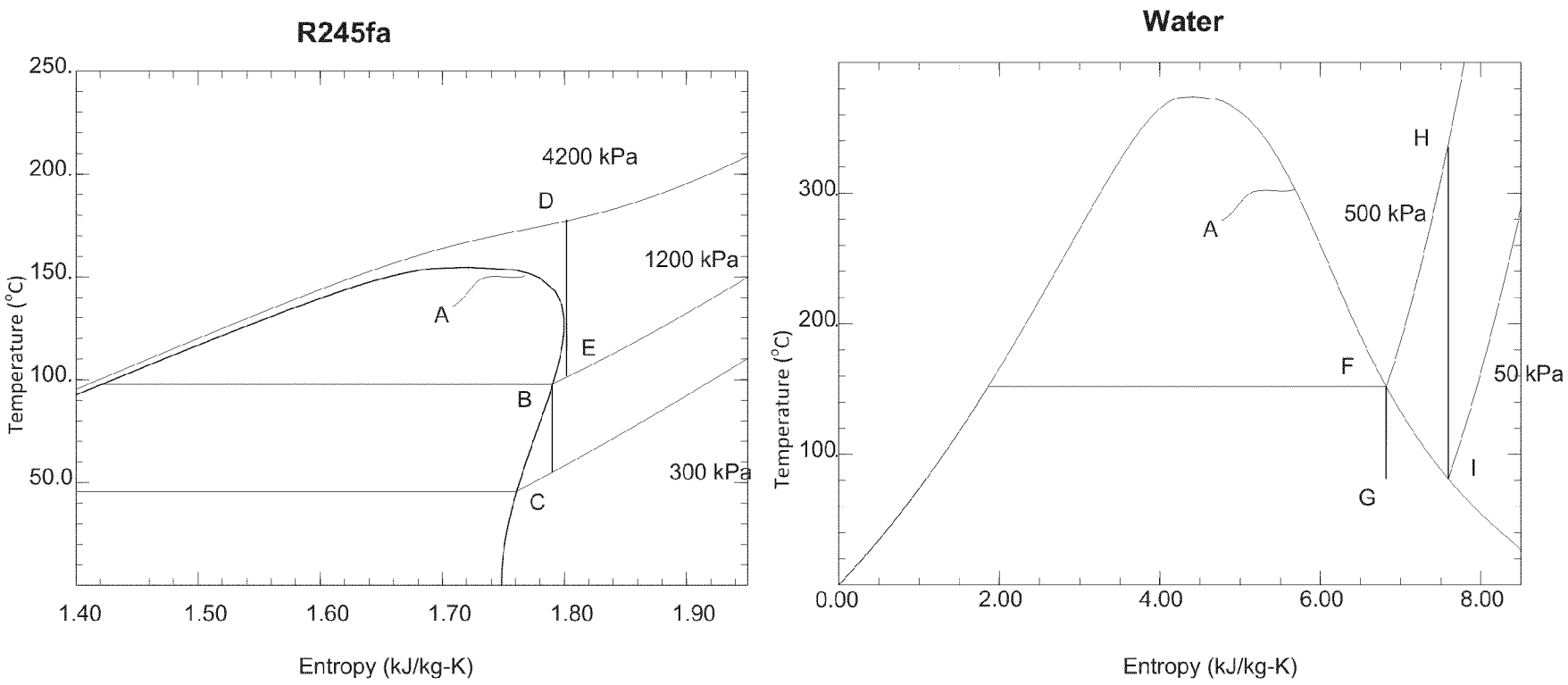
FIG. 20 illustrates temperature-entropy charts of two prototypical Rankine media fluids.

FIG. 20 shows two temperature-entropy charts used to illustrate the operational difference between a dry type and wet type Rankine cycle working fluid. The first chart is for R245fa which is a dry type working fluid. The second chart is for water which is a typical wet type working fluid. The line 'A' in both charts is the saturation line, when the system is operating in the dome area under the line it is in the mixed area, where the fluid is a mixture of both liquid and vapor. Once the operating point is on the line or has passes to the outside of the dome to the right, the fluid would be 100% vapor.

Operation of a typical LTLP circuit in a Rankine cycle with R245fa as the working fluid would follow pressure curves as drawn in the T-s diagram on the left. Condensing would happen at a pressure of 300 kPa which determines that the fluid will condense at a temperature of approximately 45 C. The fluid would then be pressurized to 1200 kPa which will set the boiling temperature to approximately 96 C. At point B, the fluid has been completely vaporized, but not superheated. At this point it could be expanded through an expander to extract energy as mechanical work. A perfect turbine would expand isentropically and this is illustrated by the vertical line connecting point B to point C. Additionally this chart illustrates a sample HTHP circuit that is operating supercritically. In the supercritical range the pressurized fluid is at an operating point above the top of the saturation dome. In this regime the fluid is pressurized to such a high pressure that the fluid doesn't pass through a constant temperature boiling phase as in the LTHP circuit, but smoothly changes density and temperature simultaneously as heat is added. At operating point D, the fluid is a high temperature supercritical vapor that can be expanded through a turbine to point E. The important criteria for point D is that it was at such a high temperature for the operating HTHP circuit pressure that when it expanded, its operating line was just outside the saturation dome, seen as line D-E to the right of the saturation dome. For certain types of expanders, they will be damaged if some of the working fluid changes phase inside of the expander.

The T-s diagram for water illustrates a typical HTHP operating line for a wet fluid. In this case the condensing line is at 50 kPa and 80 C, while the pressurized operating line is at 550 kPa where the fluid will boil at approximately 150 C. Operating point F is where all the fluid has been vaporized, but if the fluid is then isentropically expanded at this point it would immediately start becoming liquid in the expander. This liquid component in the expander could be damaging and also makes for a less efficient cycle. Proper operation of a Rankine cycle with a wet fluid would continue heating the fluid into the superheated range, up to a temperature of 324 C at point H. At this point it can be expanded to point I without the fluid passing into the saturation dome and risking damage to the expander.

A significant point brought out by these two charts is that superheating the fluid when using a dry type working fluid is not required to prevent expander damage. To improve system stability while to reducing the precision and expense of the sensors and control devices, superheating a dry type fluid some amount gives a tolerance in the operation of the system. A 5 degree superheat from point B to point E in the R245fa gives the cycle a tolerance band outside of the saturation dome that would make up for minor measurement errors in temperature and pressure sensors.

In addition to the control methods described, additional sensors and/or control algorithms may also be employed to affect other behaviors, such as protecting waste heat recovery system, the engine, and the environment. Such algorithms include; WHRS protection, engine overheat detection, environmental protection, and the like.

WHRS protection: If any of the temperature or pressure sensors exceed set point values, the controller may be directed to change operating conditions or shutdown the engine.

Engine overheat detection: If T_eng exceeds a predetermined set-point for a predetermined period of time, a signal may be sent to the engine controller to reduce engine power output or shutdown the engine.

Environmental protection: Should the sensors indicate that Rankine media is being lost, the controller may signal the operator to check the system, it may shutdown the system, or it may extract all of the remaining Rankine media into TANK 34.

Figure 21:
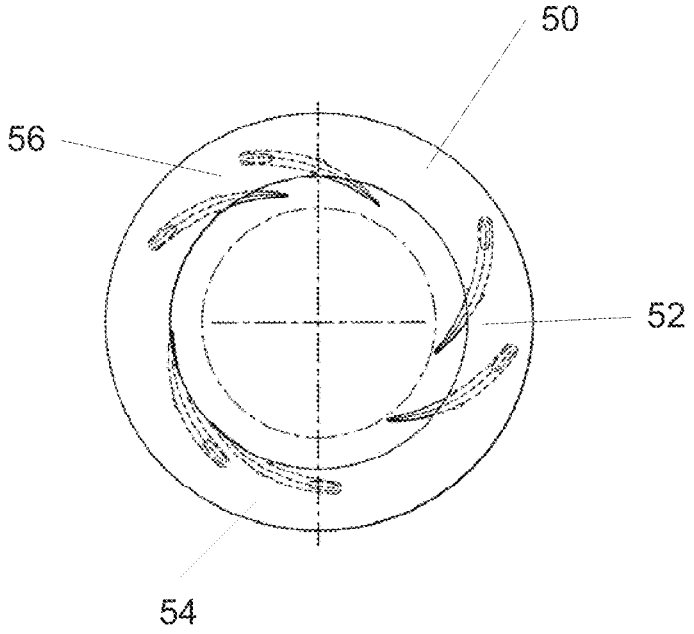
FIG. 21 illustrates an example of variable inlet geometry for a turbine type expander.

FIG. 21 illustrates an example of variable inlet geometry for a turbine type expander. Turbine inlet 50 illustrates the turbine body with several representative sets of turbine blades. Blades 52 represent an open inlet geometry configuration, one which causes the least system back pressure. Blades 54 represent a closed inlet geometry configuration, one which causes the greatest system back pressure. Blades 56 represent an intermediate inlet geometry configuration, one which causes an intermediate amount of system back pressure.

While certain representative embodiments and details have been shown for purposes of illustrating the disclosure, it will be apparent to those skilled in the art that various changes may be made without departing from the scope of the disclosure, which is further described in the following appended claims.

I claim:

1. A method of extracting useful work from a plurality of heat streams comprising the steps of:

providing a single working fluid in a closed loop;

condensing the single working fluid in a condenser;

pressurizing the single working fluid to a first pressure in a low pressure media pump;

splitting the single working fluid into a first portion and a second portion;

heating the first portion of the single working fluid using a group of heat exchangers comprising at least a recuperating heat exchanger and at least a first heat exchanger, wherein the first portion has the first pressure;

pressurizing the second portion of the single working fluid in a high pressure media pump to a higher pressure, wherein the higher pressure is greater than the first pressure;

heating the second portion of the single working fluid pressurized at the higher pressure using a second heat exchanger, partially expanding the second portion of the single working fluid pressurized at the higher pressure to the first pressure by a high pressure expander; and combining the partially expanded second portion of the single working fluid with the first portion of the single working fluid and then expanding the single working fluid by a second expander; and recuperating the combined single working fluid using the group of heat exchangers, wherein the group of heat exchangers operates in parallel with the second heat exchanger, wherein the high pressure media pump operates in series with the low pressure media pump, and the high pressure expander operates in series with the second expander.

2. The method of claim 1, wherein the second portion of the single working fluid is pressurized in the high pressure media pump and heated in the second heat exchanger to a super critical state.

* * * * *